US006011561A

United States Patent [19]

Shigi et al.

[11] Patent Number: 6,011,561

[45] Date of Patent: Jan. 4, 2000

[54] APPARATUS FOR GENERATING CHARACTER PATTERN ACCORDING TO CONTOUR INFORMATION BASED ON CORRECTED STROKE INFORMATION

[75] Inventors: Yutaka Shigi; Megumi Ito, both of Nara; Susumu Hasegawa, Sakai; Yuka Yabuuchi, Yamatokoriyama; Hajime Watanabe, Osaka, all of Japan

[73] Assignee: Sharp Kabushiki Kaisha, Osaka, Japan

[21] Appl. No.: 08/892,093

[22] Filed: Jul. 14, 1997

[30] Foreign Application Priority Data

Jul. 30, 1996 [JP] Japan ..... 8-200772

[51] Int. Cl.[7] ..... G09G 5/24

[52] U.S. Cl. ..... 345/471; 345/194

[58] Field of Search ..... 382/187, 203, 382/185; 395/167; 345/467, 468, 471, 141, 194, 195

[56] References Cited

U.S. PATENT DOCUMENTS

| | | | |
|---|---|---|---|
| 4,897,638 | 1/1990 | Kokunishi et al. | 340/751 |
| 5,416,898 | 5/1995 | Opstad et al. | 395/150 |
| 5,468,077 | 11/1995 | Motokado et al. | 395/151 |
| 5,537,131 | 7/1996 | Mitsuhashi et al. | 345/141 |
| 5,586,241 | 12/1996 | Bauermeister et al. | 395/167 |
| 5,727,140 | 3/1998 | Ohtomo et al. | 395/167 |
| 5,771,035 | 6/1998 | Imaki et al. | 345/143 |
| 5,870,107 | 2/1999 | Fujisawa et al. | 345/467 |

FOREIGN PATENT DOCUMENTS

| | | | |
|---|---|---|---|
| 63-70290 | 3/1988 | Japan | G06F 15/66 |
| 4-340590 | 11/1992 | Japan | G06F 15/20 |

*Primary Examiner*—Andrew W. Johns

[57] ABSTRACT

A character generator is formed by a microcomputer and has a structure in which character structure information including radical structure information representing a kind and a position/size of a radical of kanji or like characters and each stroke information other than the radical is stored for each character code and for each typeface in a ROM. Each stroke information of the radical based on the radical structure information is stored for each typeface in the ROM. and contour information corresponding to the stroke information is stored for each typeface in the ROM. A CPU sequentially reads and positions the stroke information such as the radical corresponding to the typeface, and assigns the contour information to generate a character pattern. Consequently, a data capacity can be reduced to generate, according to the kind of the typeface, a character pattern of high quality which takes a stroke shape of the radical and a balance thereof into consideration.

16 Claims, 18 Drawing Sheets

C100

| | |
|---|---|
| Radical part number | B100 |
| P1 | |
| P2 | |
| Sticking part number | F100 |
| P3 | |
| P4 | |
| Sticking part number | F200 |
| P5 | |
| P6 | |
| P7 | |
| Radical part number | B200 |
| P8 | |
| P9 | |

C100

| TYPEFACE 1 | TYPEFACE 2 |
|---|---|
| NULL | NULL |
| NULL | ΔP1 |
| NULL | ΔP2 |
| NULL | Sticking part number F101 |
| NULL | ΔP3 |
| NULL | NULL |
| NULL | NULL |
| NULL | NULL |
| NULL | NULL |
| NULL | ΔP7 |
| NULL | Radical part number B201 |
| NULL | ΔP8 |
| NULL | NULL |

Fig. 6c

B100

| | |
|---|---|
| Sticking part number | F300 |
| BP1 | |
| BP2 | |
| Sticking part number | F400 |
| BP3 | |
| BP4 | |
| Sticking part number | F500 |
| BP5 | |
| BP6 | |
| BP7 | |
| BP8 | |

Fig. 6d

B100

| | |
|---|---|
| Sticking part number | F300 |
| BP11 | |
| BP12 | |
| Sticking part number | F101 |
| BP13 | |
| BP14 | |
| Sticking part number | F500 |
| BP15 | |
| BP16 | |
| BP17 | |
| BP18 | |

Fig. 7

Typeface 2

B100

| | |
|---|---|
| NULL | |
| ΔBP1 | |
| NULL | |
| Sticking part number | F101 |
| ΔBP3 | |
| NULL | |
| NULL | |
| NULL | |
| ΔBP6 | |
| ΔBP7 | |
| ΔBP8 | |

Fig. 10a

207 Radical restoring section

| | |
|---|---|
| 207-10 | Radical pattern retrieving section |
| 207-20 | Basic skeleton restoring section |
| 207-30 | Radical pattern changing section |

Fig. 10b 207-20 Basic skeleton restoring section

| | |
|---|---|
| 207-21 | Basic skeleton pattern retrieving section |
| 207-22 | Stroke pattern retrieving section |
| 207-23 | Basic skeleton pattern restoring section |

Fig. 11a

208 Correcting section

| | |
|---|---|
| 208-10 | Radical pattern change information deciding section |
| 208-20 | Basic skeleton correcting section |

Fig. 11b 208-20 Basic skeleton correcting section

| | |
|---|---|
| 208-21 | Rotating angle information deciding section |
| 208-22 | Basic skeleton rotating section |
| 208-23 | Arrangement coordinate movement information deciding section |
| 208-24 | Basic skeleton arrangement coordinate moving section |
| 208-25 | Exchange information deciding section |
| 208-26 | Basic skeleton exchanging section |
| 208-27 | Skeleton point movement information deciding section |
| 208-28 | Skeleton point moving section |

Fig. 13a

203 Radical pattern data storing section

| | |
|---|---|
| 203-10 Number of radical patterns | |
| | 203-20 Basic skeleton shape information |
| | 203-30 Basic skeleton synthesis information |

Fig. 13b 203-20 Basic skeleton shape information

| | | |
|---|---|---|
| 203-21 Basic skeleton pattern code KC1 | | |
| 203-22 Stroke pattern code SC1 | 203-23 Number of skeleton points 2 | 203-24 Pointer to skeleton point coordinate data |
| 203-25 Number of skeleton points for one basic skeleton pattern | | |
| 203-26 Coordinate data on skeleton point of basic skeleton pattern (kx1, ky1) (kx2, ky2) | | |
| ⋮ | | |

Fig. 13c 203-30 Basic skeleton synthesis information

| | | |
|---|---|---|
| 203-31 Radical skeleton pattern code C1<br>Number of basic skeleton patterns 4 | | |
| 203-32 Basic skeleton pattern code KC1 | 203-33 Number of reference points 2 | 203-34 Pointer to basic skeleton pattern arrangement reference coordinate data |
| ⋮ | | |
| 203-35 Number of reference points for one basic skeleton pattern | | |
| 203-36 Coordinate data on reference point of basic skeleton pattern (gx1, gy1) (gx2, gy2) | | |
| ⋮ | | |

205 Correction data storing section

Fig. 15b 205-20 Basic skeleton correction information

| | | | | | | |
|---|---|---|---|---|---|---|
| 205-21 Radical pattern correction flag 1 | | | | | | |
| Contour transformation information | 205-22 Correction basic skeleton pattern code 7 | | | | | |
| | 205-23 Rotating angle information Rotating angle θ | | | | | |
| | Arrangement coordinate movement information | 205-24 Reference point movement information | hx1 | Coordinate difference data | hx1−ix1 | |
| | | 205-25 Reference point movement information | hy1 | Coordinate difference data | hy1−iy1 | |
| | | 205-26 Reference point movement information | hx2 | Coordinate difference data | hx2−ix2 | |
| | | 205-27 Reference point movement information | hy2 | Coordinate difference data | hy2−iy2 | |
| | 205-28 Exchange information decision data | Basic skeleton number | 0 | | | |
| Skeleton transformation information | 205-29 Number of basic skeleton points | Number of basic skeleton pattern points | 0 | | | |
| | 205-30 Change point number | | | | | |
| | 205-31 Skeleton point movement information | nx1 | Coordinate difference data | nx1−nx2 | | |
| | 205-32 Skeleton point movement information | ny1 | Coordinate difference data | ny1−ny2 | | |
| ⋮ | | | | | | |

APPARATUS FOR GENERATING CHARACTER PATTERN ACCORDING TO CONTOUR INFORMATION BASED ON CORRECTED STROKE INFORMATION

BACKGROUND OF THE INVENTION

1. Field of the Invention

The present invention relates to a character generator, and more particularly to a character generator applied to an electronic information apparatus such as a word processor, a computer, an electronic notebook and the like for generating character patterns from character structure information sharing strokes of radical ("bush") portions of kanji characters (Chinese characters) and like characters.

2. Description of the Background Art

Conventionally, the electronic information apparatus such as a word processor, a computer, an electronic notebook and the like comprises a character generator for generating a character font of high quality. However, the character font is generated by reading font data expressing character contours from a font memory which stores the font data corresponding to various characters. For this reason, the amount of data in the font memory is extremely large. In order to solve this problem, Japanese Unexamined Patent Publication SHO 63(1988)-70290 has disclosed a character pattern synthesizer and Japanese Unexamined Patent Publication HEI 4(1992)-340590 has disclosed a character font output device, for example.

According to the character pattern synthesizer disclosed in the Japanese Unexamined Patent Publication SHO 63(1988)-70290, a plurality of partial patterns (parts) made of a combination of strokes are synthesized to define a character pattern in one typeface, and positions and sizes of the synthesized partial patterns are corrected to produce a well-balanced character pattern. Accordingly, it is possible to store and share partial patterns for each stroke and to adjust the shapes of partial patterns and a balance with other partial patterns.

According to the character font output device disclosed in the Japanese Unexamined Patent Publication HEI 4(1992) 340590, character components such as a line of one stroke, a point thereof and the like and components forming common portions such as radicals are hierarchically stored as parts. Parts are combined according to the shape of characters, and also characters themselves are utilized as parts for other characters, thereby to generate a character font.

According to the character pattern synthesizer disclosed in the Japanese Unexamined Patent Publication SHO 63(1988)-70290, however, generation of character data corresponding to a plurality of typefaces is not taken into consideration, and character data generated in typefaces other than that stored in character data have a problem in respect of the shapes of the partial patterns and the balance.

According to the character font output device disclosed in the Japanese Unexamined Patent Publication HEI 4(1992)-340590, the components such as lines of strokes, points thereof and the like and the components forming common portions such as radicals are simply combined to generate characters. For this reason, the shape of a radical portion is not always restored to fit in a generated character. Consequently, there is a problem that the character is degraded.

SUMMARY OF THE INVENTION

In consideration of the above-mentioned circumstances, the present invention provides a character generator in which stroke information (skeleton information) on radical portions forming kanji is shared, is transformed according to contour information representing a typeface, and is hierarchically stored as parts. An input character code, the stroke information thereon such as radical portions corresponding to a typeface and the contour information thereon are sequentially read to generate a character pattern (kanji pattern), whereby the amount of data can be reduced, and character patterns of high quality having well-balanced strokes of the radicals in good shape can be generated according to the kind of the typeface.

The present invention provides a character generator comprising an input section for inputting information such as a character code, a typeface, and a character size of a character pattern to be generated, a character information storing section for storing, for each character code, character structure information including radical structure information representing a kind and a position size of a radical of a kanji and stroke information on each stroke other than the radical, a radical information storing section for storing, for each typeface, stroke information on each stroke of the radical based on the radical structure information, a contour information storing section for storing, for each typeface, contour information corresponding to the stroke information, a stroke information reading section for reading, from the character information storing section, the radical structure information and the stroke information on each stroke other than the radical included in one character structure information according to the character code and the typeface input by the input section, reading the stroke information on the radical corresponding to the read radical structure information from the radical information storing section, a character generating section for reading the contour information corresponding to the read stroke information from the contour information storing section according to the input typeface and generating one character pattern, and an output section for outputting the generated character pattern.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention and wherein:

FIGS. 6*a* to 6*d* are diagrams showing radical information stored in a radical information storing section and changed radical information according to the present invention;

FIG. 7 is a diagram showing transformed radical information stored in a radical transformation information storing section according to the present invention;

FIGS. 10*a* and 10*b* are block diagrams showing structures of a radical restoring section and a basic skeleton restoring section according to the present invention, respectively;

FIGS. 11*a* and 11*b* are block diagrams showing structures of a correcting section and a basic skeleton correcting section according to the present invention, respectively;

FIGS. 13*a* to 13*c* are block diagrams showing a structure of a radical pattern data storing section, basic skeleton shape information and basic skeleton synthesis information, respectively;

FIGS. 15*a* and 15*b* are block diagrams showing a structure of a correction data storing section and basic skeleton correction information, respectively;

DESCRIPTION OF PREFERRED EMBODIMENTS

Preferred embodiments of the present invention will be described below in detail with reference to the drawings. The present invention is not restricted to the following embodiments. A character generator according to the present invention is particularly applied as a device for generating kanji patterns in various typefaces in an electronic information processing apparatus such as a word processor, a computer, an electronic notebook and the like.

Figure 1:
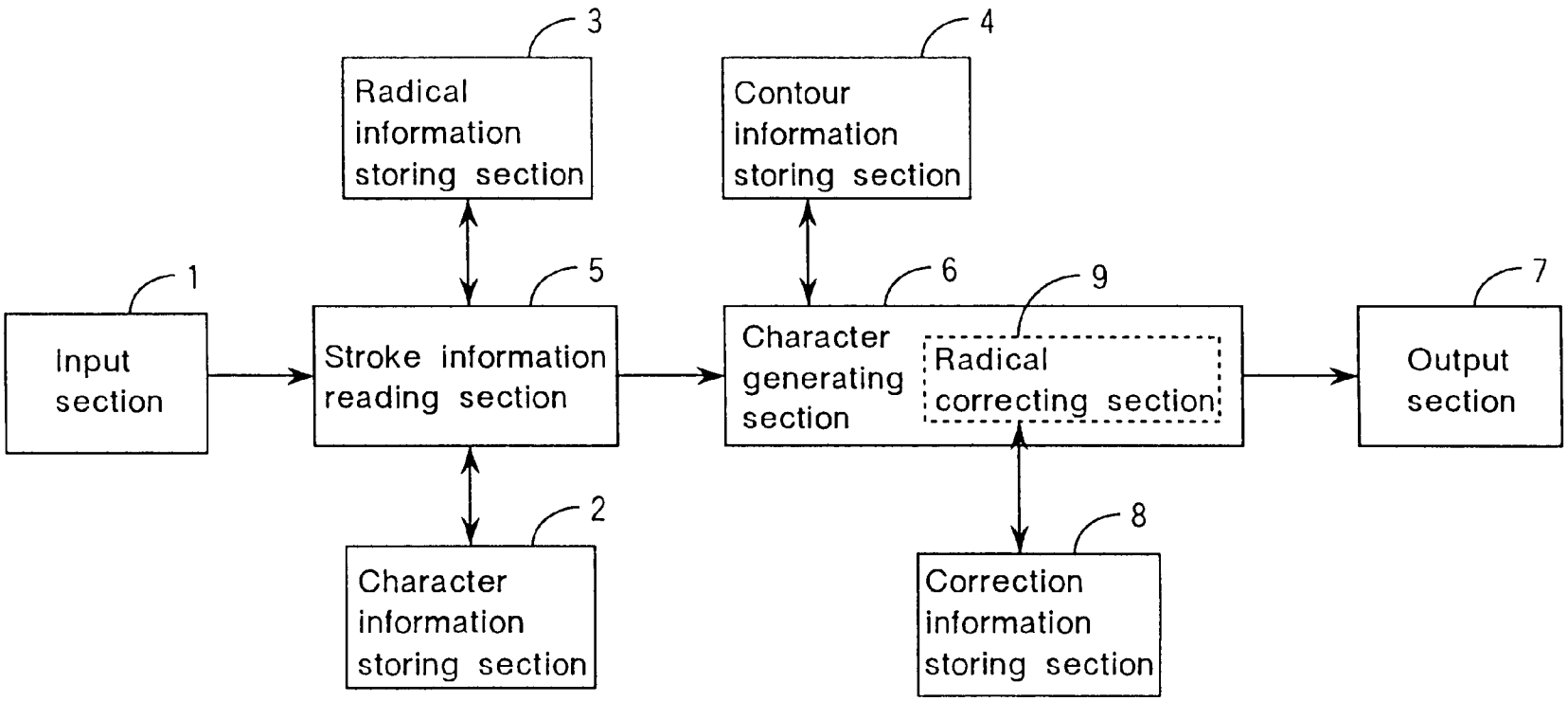
FIG. 1 is a block diagram showing a basic structure of a character generator according to the present invention.

FIG. 1 is a block diagram showing a basic structure of the character generator according to the present invention. As shown in FIG. 1, character structure information including radical structure information representing the kind and the position/size of a radical of a kanji character and stroke information on each of the stroke(s) other than the radical is stored for each character code in a character information storing section 2. The stroke information on each of the stroke(s) of the radical based on the radical structure information is stored for each typeface in a radical information storing section 3. Contour information corresponding to the stroke information is stored for each typeface in a contour information storing section 4. When information such as a character code, a typeface, a character size and the like of a character pattern to be generated is input by an input section 1, a stroke information reading section 5 reads the radical structure information and the stroke information on the strokes other than the radical included in one character structure information from the character information storing section 2 according to the character code and typeface input by the input section 1. Further, the stroke information on the radical corresponding to the read radical structure information is read from the radical information storing section 3. A character generating section 6 reads the contour information corresponding to the read stroke information from the contour information storing section 4 according to the input typeface, and generates one character pattern. An output section 7 is constructed to output the generated character pattern.

According to the present invention, the input section 1 is made of an input device such as a keyboard, a pentablet and the like.

The character information storing section 2, the radical information storing section 3, the contour information storing section 4, the stroke information reading section 5 and the character generating section 6 are made of a microcomputer comprising a CPU, a ROM, a RAM and an I/O port. In particular, the character information storing section 2, the radical information storing section 3 and the contour information storing section 4 are made of a ROM or a floppy disk which is an external storage. The ROM stores a program to allow the CPU to function as the stroke information reading section 5 and the character generating section 6.

The output section 7 is made up of a display unit such as an LCD (liquid crystal display) or a CRT display, and a printer such as a thermal printer or a laser printer.

According to the present invention, the character structure information including the radical structure information representing the kind and the position/size of a radical of a kanji character and the stroke information on the other strokes than the radical is stored for each character code and each typeface. The stroke information on each of the strokes forming the radical based on the radical structure information is stored for each typeface. The contour information corresponding to the stroke information is stored for each typeface. The stroke information on the radical and the like corresponding to the typeface is sequentially read and positioned. The contour information is assigned so that a character pattern is generated. Consequently, a reduced amount of data is required for generating character patterns of high quality which are well balanced and well shaped in various typefaces.

Preferably, the radical structure information stored in the character information storing section 2 includes a part number representing the kind of a radical and coordinates of two points representing the position/size thereof.

It is preferred that the stroke information on the strokes other than the radical stored in the character information storing section 2 should include a part number of contour information representing a stroke shape and coordinates of skeleton points representing the position/size thereof.

Preferably, the radical information storing section 3 stores a part number representing the kind of a radical, a part number of contour information representing a stroke shape of the radical corresponding to the part number, and coordinates of skeleton points based on the radical structure information.

It is preferred that the contour information stored in the contour information storing section 4 should include a part number of contour information representing a stroke shape and coordinate information on a contour point corresponding to the part number.

According to the above-mentioned structure, the stroke information (skeleton information) on radicals forming kanji characters are shared and the contour information representing typefaces are hierarchically stored as parts for strokes. Consequently, the amount of stored data can be reduced.

The stroke information representing the basic shape of strokes, in particular, the stroke information on radicals can be adapted to the contour information representing typefaces to change the shape thereof. Therefore, well-balanced character patterns can be generated in various typefaces.

Preferably, the character generator further comprises a correction information storing section 8 for storing correction information for correcting a stroke of the radical according to the shape of the character pattern, and a radical correcting section 9 for correcting the contour, skeleton, inclination, arrangement and the like of a stroke of the radical based on the correction information.

It is preferred that the correction information should include contour transformation information, skeleton transformation information and rotating angle information for the stroke of the radical.

With the above-mentioned structure, the correction information storing section 8 may be made of a ROM of a microcomputer, and the radical correcting section 9 may be made of a CPU.

According to the above-mentioned structure, the contour, skeleton and inclination of the stroke of the radical are corrected in accordance with the shape or typeface of a character pattern based on the correction information including the contour transformation information, the skeleton transformation information and the rotating angle information. Thus, a well-balanced character pattern can be generated.

Preferably, the correction information storing section 8 further has the function of storing correction information including arrangement coordinate movement information, basic skeleton exchange information and skeleton point movement information for the stroke of the radical, and the radical correcting section 9 further has the function of moving the stroke of the radical on the arrangement coordinate movement information, that of exchanging the skeleton of the stroke based on the basic skeleton exchange information, and that of moving the skeleton point of the stroke based on the skeleton point movement information.

With the above-mentioned structure, since strokes of radicals can be moved, changed in shape and exchanged, well-balanced character patterns can be generated in various typefaces without increasing the amount of data.

Figure 2:
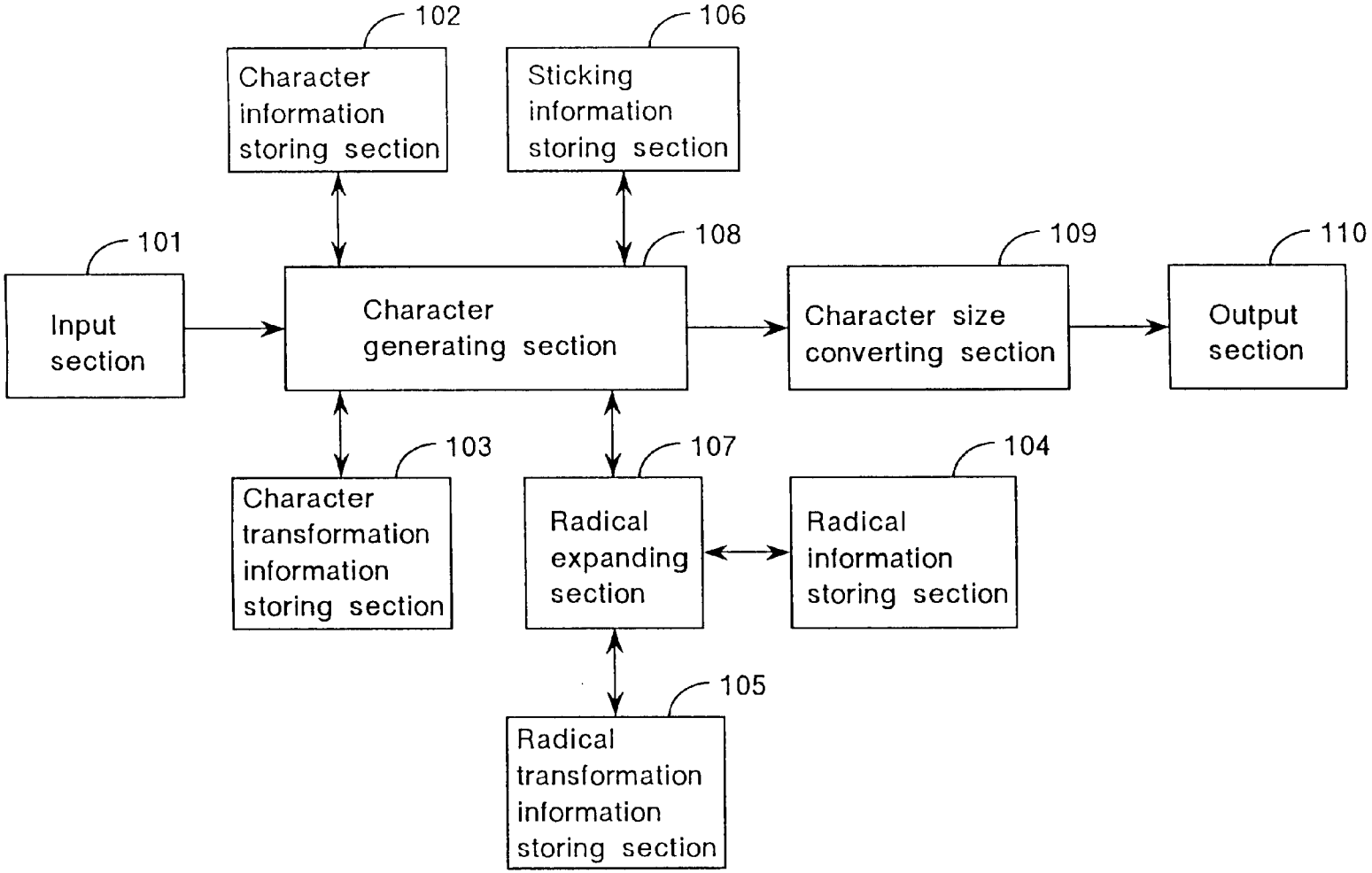
FIG. 2 is a block diagram showing a structure of a character generator according to Embodiment 1 of the present invention.

FIG. 2 is a block diagram showing a structure of a character generator according to Embodiment 1 of the present invention. In FIG. 2, the reference numeral 101 denotes an input section comprising a keyboard or a pentablet which functions as the input section 1 shown in FIG. 1.

The reference numeral 102 denotes a character information storing section which functions as the character information storing section 2 shown in FIG. 1, the reference numeral 103 denotes a character transformation information storing section, the reference numeral 104 denotes a radical information storing section which functions as the radical information storing section 3 shown in FIG. 1, the reference numeral 105 denotes a radical transformation information storing section, the reference numeral 106 denotes a sticking information storing section which functions as the contour information storing section 4 shown in FIG. 1, the reference numeral 107 denotes a radical expanding section, the reference numeral 108 denotes a character generating section, and the reference numeral 109 denotes a character size converting section, which are made up of a microcomputer comprising a CPU, a ROM, a RAM and an I/O port.

The radical expanding section 107 and the character generating section 108 function as the stroke information reading section 5 and the character generating section 6 shown in FIG. 1.

In particular, the character information storing section 102, the character transformation information storing section 103, the radical information storing section 104, the radical transformation information storing section 105 and the sticking information storing section 106 are made up of a ROM. The ROM stores programs to allow the CPU to function as the radical expanding section 107, the character generating section 108 and the character size converting section 109.

The reference numeral 110 denotes an output section which functions as the output section 7 in FIG. 1 made of a display unit such as an LCD (liquid crystal display) or a CRT display and a printer such as a thermal printer, a laser printer or the like.

The input section 101 is for inputting information, for example, the character code, typeface information and size of a character pattern to be generated.

Figures 4A, 4B, 5:
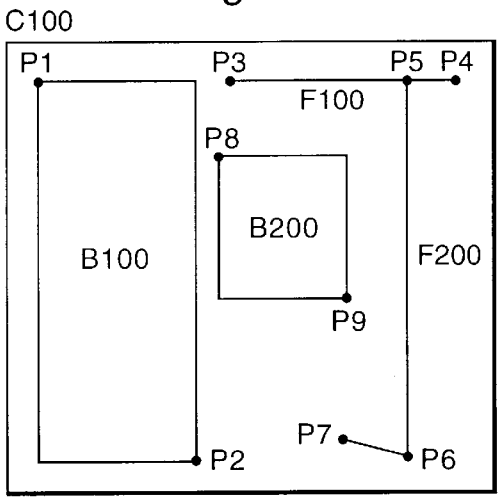
FIGS. 4*a* and 4*b* are diagrams showing character structure information stored in a character information storing section according to the present invention.
FIG. 5 is a diagram showing transformed character structure information stored in a character transformation information storing section according to the present invention.

The character information storing section 102 stores, for each character code, character structure information including radical structure information representing the kind, position, size and the like of a radical of kanji, and inherent stroke information (skeleton information) on strokes other than the radical (see FIGS. 4*a* and 4*b*). The character transformation information storing section 103 stores, in the ROM, transformed character structure information for changing the character structure information according to the kind of a typeface (see FIG. 5). The character information storing section 102 and the character transformation information storing section 103 can be treated as one character information storing section.

The radical information storing section 104 stores the stroke information on a radical based on the radical structure information (see FIGS. 6*a* to 6*d*). The radical transformation information storing section 105 stores transformed radical information for changing radical information according to the kind of a typeface (see FIG. 7). Similarly, the radical information storing section 104 and the radical transformation information storing section 105 can be treated as one radical information storing section.

Figure 8A:
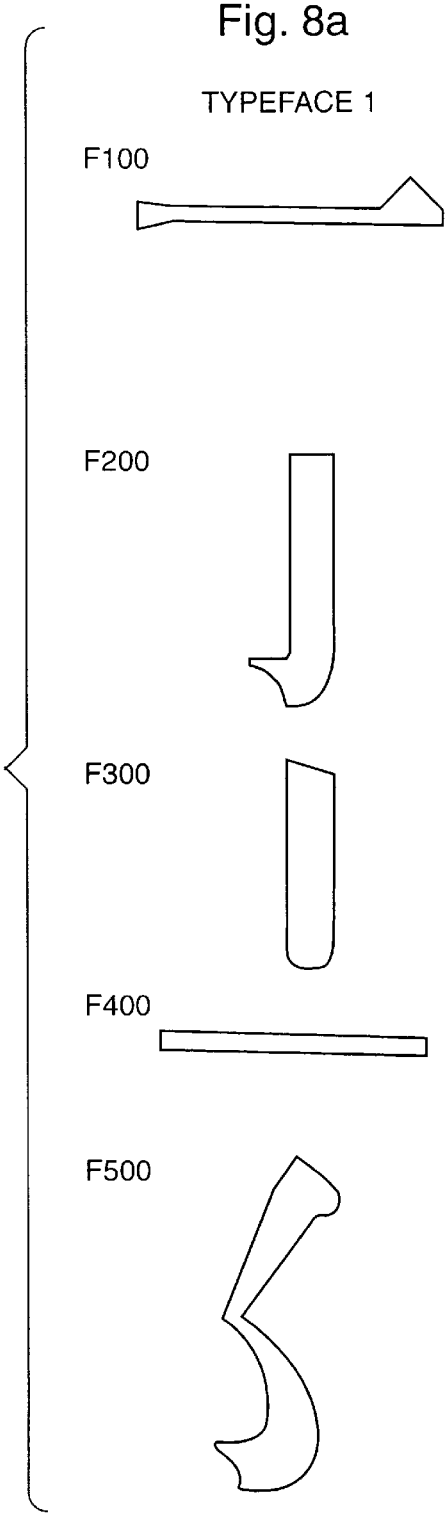
FIGS. 8*a* and 8*b* are diagrams showing sticking information stored in a sticking information storing section according to the present invention.
Figure 8B:
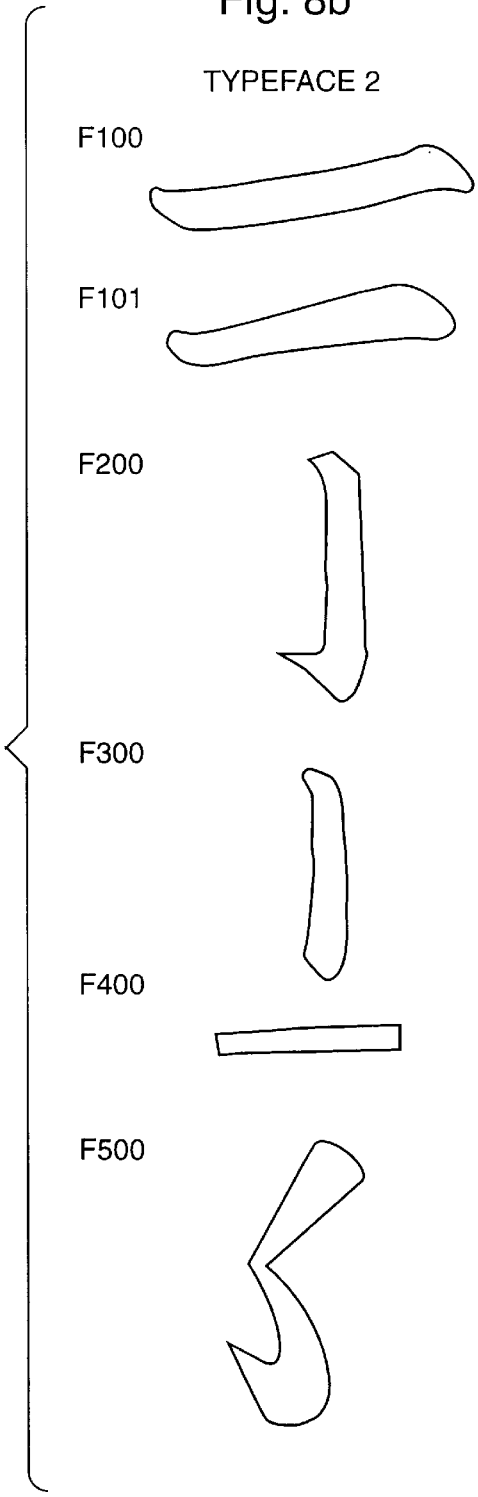

The sticking information storing section 106 stores, for each typeface, sticking information (contour information) to be used when generating a character pattern from the skeleton information of strokes (see FIGS. 8*a* and 8*b*).

The radical expanding section 107 receives the radical structure information representing the kind of a radical and the like from the character generating section 108, and reads the stroke information about a corresponding radical from the radical information storing section 104 or the radical transformation information storing section 105 and transfers the same to the character generating section 108.

The character generating section 108, based on a character code, the kind of a typeface and the size input by the input section 101, reads the radical structure information and stroke information other than the radical included in the character structure information for the character code from the character information storing section 102, transfers the read radical structure information to the radical expanding section 107, positions the radical stroke information read by the radical expanding section 107 and the stroke information other than the radical, and reads the contour information corresponding to the read stroke information from the sticking information storing section 106 according to the typeface so that a corresponding character pattern is generated.

The character size converting section 109 converts the character pattern generated by the character generating section 108 into a character having the input size.

Figure 3:
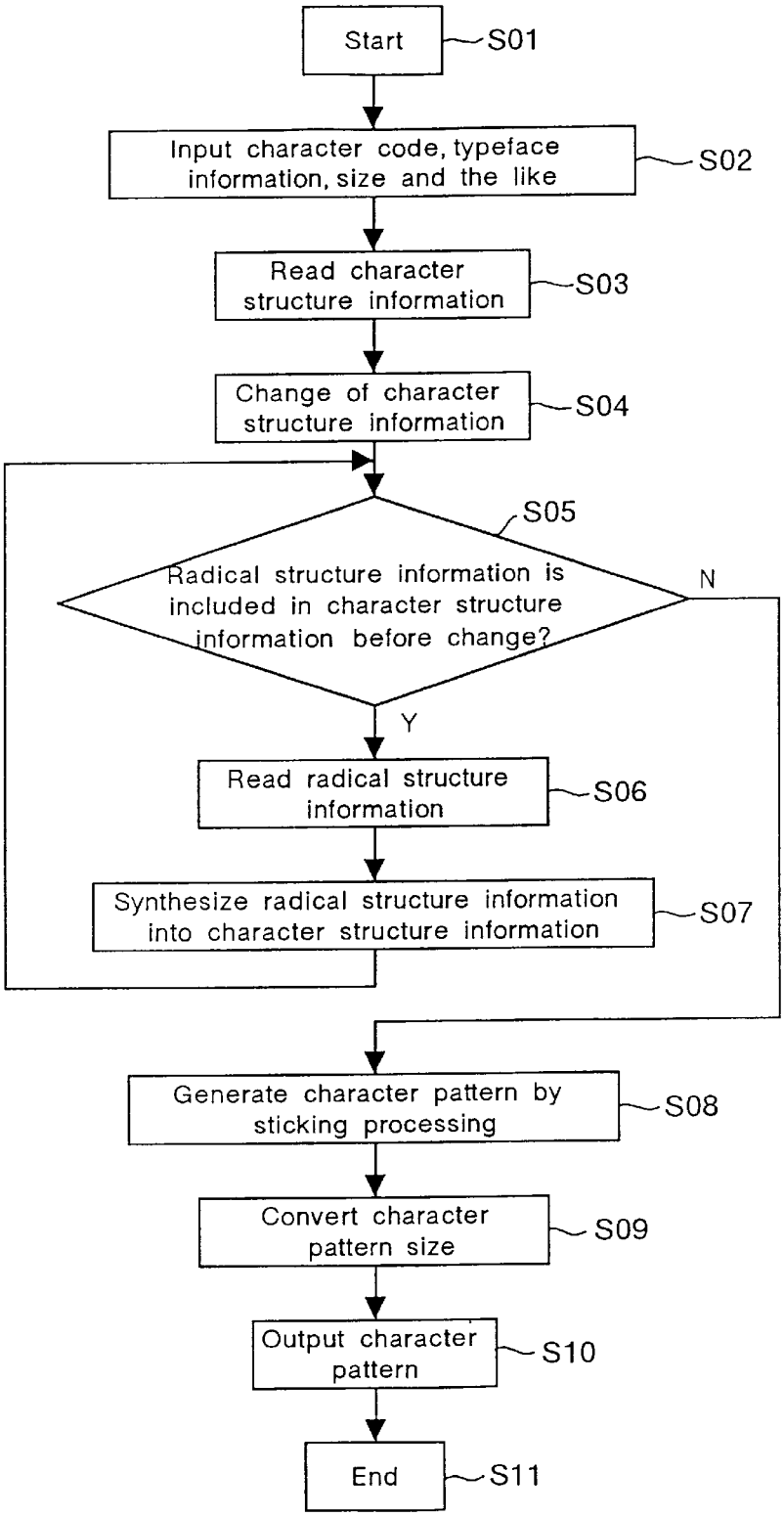
FIG. 3 is a flowchart showing a processing procedure of the character generator according to Embodiment 1 of the present invention.

FIG. 3 is a flowchart showing the operation of the character generator according to Embodiment 1 of the present invention. In FIG. 3, for example, a processing procedure of sequentially selecting and generating character patterns in two typefaces (typefaces 1 and 2) from one character structure information is below described step by step.

Step S01: A processing is started.

Step S02: A character code of a character pattern to be generated, typeface information indicating the kind of a typeface, and information about a character size to be output and the like are input by the input section 101.

step S03: The character generating section 108 reads corresponding character structure information from the character information storing section 102 according to the input character code. It is assumed that a character code C100 is input and the character structure information corresponding to the code C100 is read in the character generating section 108.

FIG. 4*a* is a diagram showing an example of character structure information stored in the character information storing section and FIG. 4*b* explains how the character structure information is stored therein, according to the present invention. FIG. 4*a* shows a character pattern "阿" corresponding to the character code C100. FIG. 4*b* shows data on the character code C100 in the character structure information stored in the character information storing section, which comprises a radical part number B100 representing a radical "kozatohen (阝)" of the character pattern "阿" and coordinates P1 and P2 of two points representing the position and size thereof, a sticking part number F100 which is contour information corresponding to an inherent stroke and coordinates P3 and p4 of skeleton points thereof, a sticking part number F200 for the other stroke and coordinates P5, P6 and P7 of skeleton points thereof, and a radical part number B200 representing a radical "口" and coordinates P8 and P9 representing the position and size thereof.

More specifically, the radical structure information stored in the character information storing section 102 include the radical part number representing the kind of the radical and the coordinates of two points representing the position and size thereof. Similarly, the stroke information on the strokes other than the radical stored in the character information storing section 102 include the part number of the contour information representing the stroke shape and the coordinates of the skeleton points representing the position and size thereof.

Step S04: The transformed character structure information corresponding to the input character code and typeface information are read from the character transformation information storing section 103 into the character generating section 108 to change the character structure information according to the typeface.

FIG. 5 explains how the transformed character structure information is stored in the character transformation information storing section according to the present invention, showing an example of data on the transformed character structure information corresponding to the typefaces 1 and 2 for the character code C100 ("阿") shown in FIGS. 4*a* and 4*b*. Since the typeface 1 is the same data as in FIGS. 4*a* and 4*b*, none of the items are changed. Therefore, the items for the typeface 1 are indicated by "NULL". As for the typeface 2, items which are not indicated by "NULL" should be changed. For example, the sticking part and the radical part are replaced with those of the indicated part numbers for the typeface 2. For coordinate data, coordinate values in the character structure information of the typeface 1 is changed to that of the typeface 2.

If the typeface 1 is input for the character code C100 to be generated, the transformed character structure information is not changed because all the transformed character structure information of the typeface 1 are "NULL". If the typeface 2 is input, coordinate values P1, P2, P3, P7 and P8 are changed by ΔP1, ΔP2, ΔP3, ΔP7 and ΔP8, respectively, the sticking part number F100 is changed to F101, and the radical part number B200 is changed to B201, according to the transformed character structure information for the character pattern of the character code C100 in the typeface 2. In other words, the radical part number, the sticking part number and the coordinates are converted by using the character structure information of the typeface 1.

Step S05: The character generating section 108 decides whether or not the radical structure information including the radical part number, position, size and the like are present in the read character structure information of the typeface 1. If the radical structure information are included in the read character structure information, the routine proceeds to Step S06. If the radical structure information is not included in the read character structure information, the routine proceeds to Step S08. For example, the radical structure information on two radicals are included in the character structure information for the character code C100 in the typeface 1. Therefore, the routine proceeds to Step S06.

Step S06: The character generating section 108 transfers the radical structure information (radical part number) and typeface information in the character structure information to the radical expanding section 107. The radical expanding section 107 reads skeleton data of a stroke of the radical part number and the sticking number from the radical information storing section 104, and reads the transformed radical information for changing the radical information depending on the typeface from the radical transformation information storing section 105.

Figure 6A:
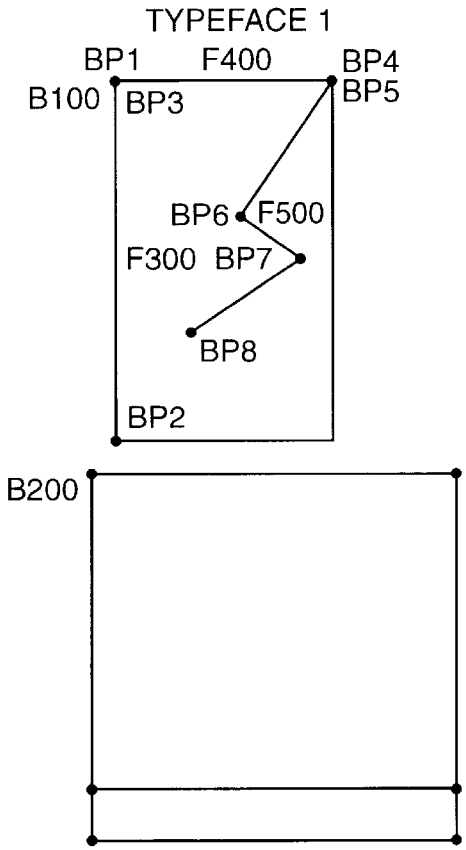
Figure 6B:
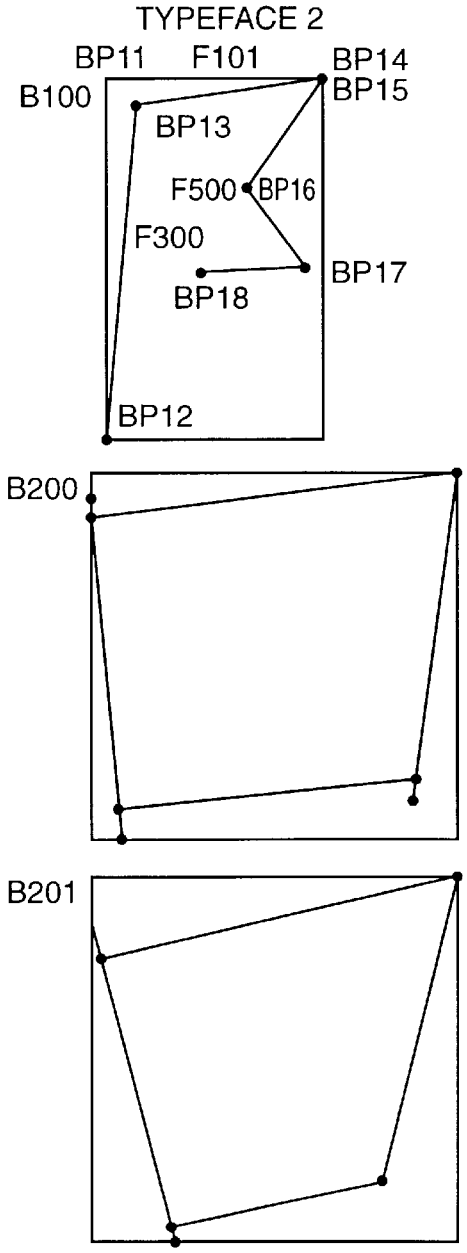

FIGS. 6*a* to 6*b* are diagrams showing an example of the radical information stored in the radical information storing section and the changed radical information, and FIGS. 6*c* and 6*d* explain how the radical information and the changed radical information are stored, according to the present invention. FIG. 6*a* shows radical information about "kozatohen (阝)" and "口" of the typeface 1. FIG. 6*c* shows how data on the radical information "阝" shown in FIG. 6*a* is stored in the radical information storing section. FIG. 6*b* shows radical information of "阝" and "凵" of the typeface 2. FIG. 6*d* shows how data on the changed radical information "阝" shown in FIG. 6*b* is stored.

Data on a radical part number B100 of the typeface 1 shown in FIG. 6*c* includes skeleton coordinates BP1 and BP2 of a sticking part number F300, skeleton coordinates BP3 and BP4 of a sticking part number F400, and skeleton coordinates BP5, BP6, BP7 and BP8 of a sticking part number F500.

More specifically, the radical structure information stored in the radical information storing section 104 includes a part number representing the kind of a radical, a sticking part number of contour information representing the stroke shape of a radical corresponding to the part number, and a coordinate of a skeleton point.

In the case where information about the typeface 1 and the radical part number B100 are transferred from the character generating section 108 to the radical expanding section 107, radical information on the radical part number B100 shown in FIG. 6*c* is read by the radical expanding section 107. In the case where information about the typeface 2 and the radical part number B100 are transferred from the character generating section 108 to the radical expanding section 107, the radical information on the radical part number B100 shown in FIG. 6*b* is changed to the radical information of the radical part number B100 shown in FIG. 6*d*.

If radical patterns in a plurality of typefaces are to be generated from the radical information for one typeface, only data on the radical information shown in FIG. 6*b* is stored in the radical information storing section 104 and the transformed radical information for changing the radical information, for example, from the typeface 1 to the typeface 2, is stored in the radical transformation information storing section 105.

FIG. 7 explains how the transformed radical information is stored in the radical transformation information storing section according to the present invention. FIG. 7 shows information for changing the radical information on the radical part number B100 of the typeface 1 to the radical information of the typeface 2.

The radical expanding section 107 reads the radical part number B100 of the transformed radical information of the typeface 2 stored in the radical transformation information storing section 105, and performs the same processing as the change of the character structure information. As a result, coordinate values ΔBP1, ΔBP3 and ΔBP6 to ΔBP8 of the transformed radical information are added to coordinate points of B100, that is, BP1, BP3 and BP6 to BP8, and the sticking part number is changed from F400 to F101 as shown in FIG. 6*d*. As shown by B100 in FIG. 6*c*, the conversion into the radical information of the typeface 2 is performed.

Step S07: The character generating section 108 reads the radical information expanded by the radical expanding section 107 and combines the radical information with the stroke information on strokes other than the radical to form a skeleton pattern for one character. Then, the routine returns to Step S05. The radical information B100 which has been read is enlarged/reduced based on the coordinates of P1 and P2 representing the position and size of the radical is positioned, and is combined with the stroke information on the strokes other than the radical.

Step S08: The character generating section 108 reads sticking information (contour information) corresponding to typefaces from the sticking information storing section 106 for the formed skeleton pattern to generate an outline font (character pattern).

FIGS. 8*a* and 8*b* show examples of the sticking information stored in the sticking information storing section according to the present invention. As shown in FIGS. 8*a* and 8*b*, the sticking information (contour information) stored in the sticking information storing section 106 includes part numbers of the contour information representing stroke shapes and coordinates of contour points corresponding to the part numbers.

In the case where the typeface 1 and the sticking part number F300 are transferred from the radical expanding section 107, the character generating section 108 reads a corresponding sticking part number from the sticking information storing section 106, enlarges/reduces the sticking part information according to the size of stroke information (skeleton information) related to F300, and generates outline data for one stroke. This processing is performed for all strokes of the character structure information to generate character patterns having an outline font.

Step S09: The character size converting section 109 enlarges/reduces the character pattern generated by the character generating section 108 to obtain a character pattern having a specified character size.

Step S10: The output section 110 outputs character data obtained by the conversion of the character size converting section 109 from the display/printer.

Step S11: The processing is ended.

Figure 9:
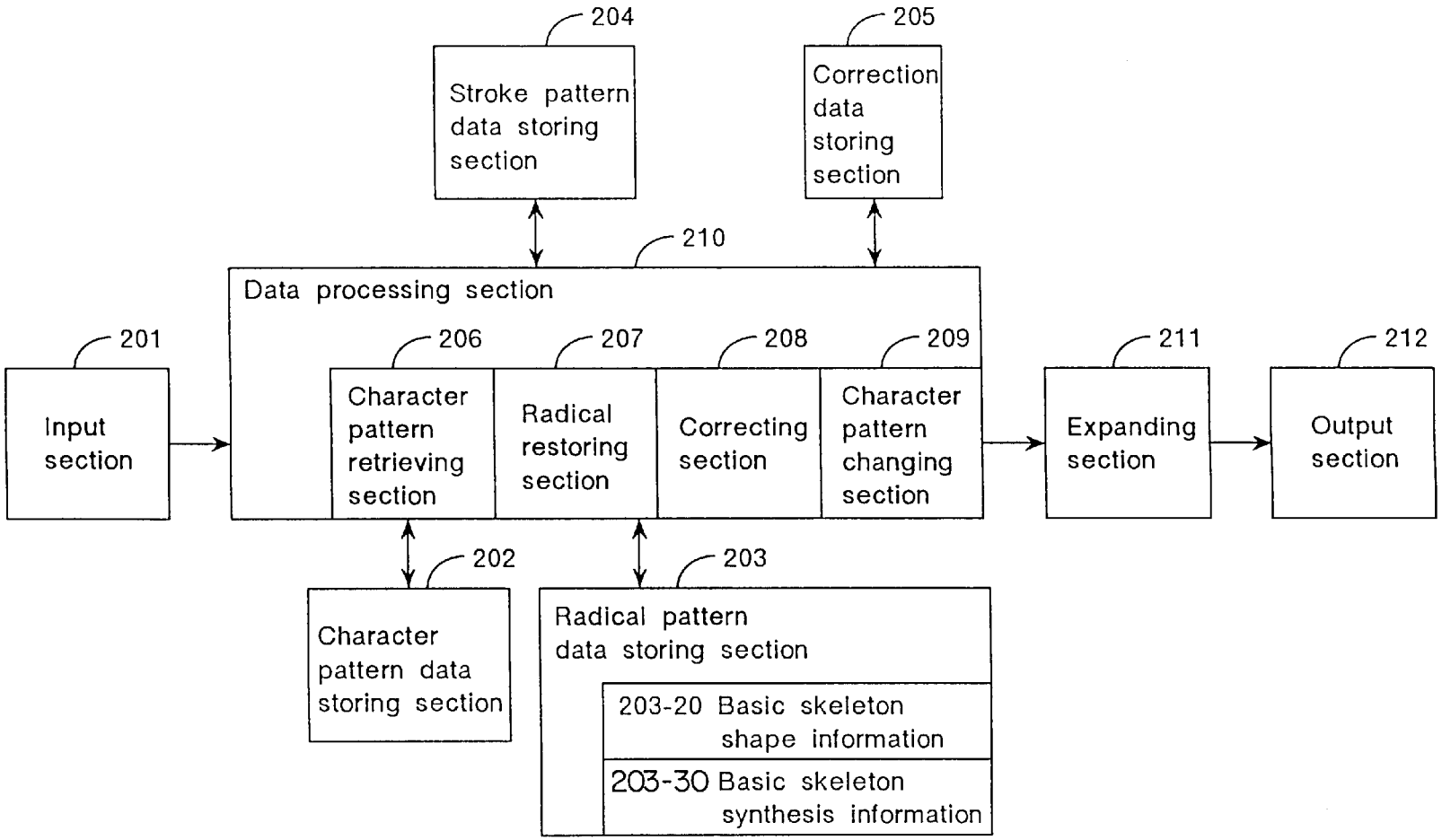
FIG. 9 is a block diagram showing a structure of a character generator according to Embodiment 2 of the present invention.

FIG. 9 is a block diagram showing a structure of a character generator according to Embodiment 2 of the present invention. In FIG. 9, the reference numeral 201 denotes an input section made up of a keyboard, a mouse, a pointing device and the like for inputting information such as a character code, a character size, a typeface and the like.

The reference numeral 202 denotes a character pattern data storing section (the character information storing section 102 shown in FIG. 2) made up of a ROM for storing character restoration information (character structure information) including character codes for individual character patterns and radical structure information representing code numbers, the positions and sizes of radical patterns forming the character patterns.

The reference numeral 203 denotes a radical pattern data storing section (the radical information storing section 104 shown in FIG. 2) made up of a ROM for storing radical restoration information including code numbers of basic skeleton patterns forming radical patterns and coordinate values of basic skeleton points of the basic skeleton patterns.

The reference numeral 204 denotes a stroke pattern data storing section (the sticking information storing section 106 shown in FIG. 2) made up of a ROM for storing stroke pattern codes (code numbers of basic skeleton patterns) and stroke pattern data (contour shape information) representing a contour shape of the stroke pattern.

The reference numeral 205 denotes a correction data storing section made up of a ROM for storing correction data for correcting a radical pattern for each character according to the shape of the character pattern.

The reference numeral 210 denotes a data processing section which is made up of a CPU, a RAM and a program memory, and has the function of retrieving character data from input data and restoring radical pattern data based on the retrieved character data and the function of correcting the restored radical pattern data based on the correction data and restoring a character pattern. The program memory stores a control program for controlling various processings. The RAM functions as a work area or a temporary buffer for executing various processings.

The reference numeral 211 denotes an expanding section made up of a bit map memory for expanding the restored character data into a dot pattern (bit map data).

The reference numeral 212 denotes an output section including a display unit such as a CRT display or an LCD (liquid crystal display) and a printer such as a line thermal printer or an ink jet printer for outputting the generated character pattern.

The data processing section 210 further includes a character pattern retrieving section 206 for retrieving a character pattern corresponding to a character code from the character pattern data storing section 202, a radical restoring section 207 for restoring a radical pattern forming the character pattern, a correcting section 208 for correcting the radical pattern for each basic skeleton pattern according to the correction data of the correction data storing section 205, and a character pattern changing section 209 for changing the character pattern according to the character size.

With the above-mentioned structure, when changing the character pattern, a plurality of stroke pattern data included in one radical pattern are individually specified, and the stroke pattern data are transformed based on the correction data and restored as respective character patterns. Accordingly, it is possible to provide a character generator for generating character patterns of high quality with a reduced amount of stored data.

FIGS. 10*a* and 10*b* are block diagrams showing structures of a radical restoring section and a basic skeleton restoring section according to the present invention, respectively. FIG. 10*a* shows the structure of a radical restoring section 207 which functions as a radical pattern retrieving section 207-10 for retrieving a radical pattern corresponding to a radical pattern code in the character pattern data storing section 202 from the radical pattern data storing section 203, a basic skeleton restoring section 207-20 for restoring a basic skeleton pattern forming the radical pattern, and a radical pattern changing section 207-30 for changing the radical pattern based on the radical restoration information.

FIG. 10*b* shows a structure of the basic skeleton restoring section 207-20 which functions as a basic skeleton pattern retrieving section 207-21 for retrieving a basic skeleton pattern from basic skeleton shape information 203-20 in the radical pattern data storing section 203, a stroke pattern retrieving section 207-22 for retrieving a stroke pattern from the stroke pattern data storing section 204, and a basic skeleton pattern restoring section 207-23 for changing the basic skeleton pattern on the basis of basic skeleton synthesis information (203-30).

FIGS. 11*a* and 11*b* are block diagrams showing structures of the correcting section and a basic skeleton correcting section according to the present invention. FIG. 11*a* shows the structure of the correcting section 208 which functions as a radical pattern change information deciding section 208-10 for deciding whether or not the radical pattern data is to be corrected, and a basic skeleton correcting section 208-20 for retrieving the basic skeleton correction information according to the shape of a character pattern and correcting the basic skeleton pattern.

FIG. 11*b* shows the structure of the basic skeleton correcting section 208-20 in the correcting section 208. The basic skeleton correcting section 208-20 functions as a rotating angle information deciding section 208-21 for deciding on the presence of rotating angle information on the basic skeleton pattern, a basic skeleton rotating section 208-22 for rotating a basic skeleton on the basis of the rotating angle information if it is decided that the rotating angle information is present, an arrangement coordinate movement information deciding section 208-23 for deciding on the presence of arrangement coordinate movement information on the basic skeleton pattern, a basic skeleton arrangement coordinate moving section 208-24 for moving the arrangement coordinate of the basic skeleton on the basis of the arrangement coordinate movement information if it is decided that the arrangement coordinate movement information is present, an exchange information deciding section 208-25 for deciding on the presence of a basic skeleton pattern code of the basic skeleton pattern, a basic skeleton exchanging section 208-26 for exchanging the basic skeleton on the basis of basic skeleton exchange information if it is decided that the basic skeleton exchange information is present, a skeleton point movement information deciding section 208-27 for deciding on the presence of skeleton point movement information of the basic skeleton pattern, and a skeleton point moving section 208-28 for moving a skeleton point on the basis of the skeleton point movement information if it is decided that the skeleton point movement information is present.

Figure 12:
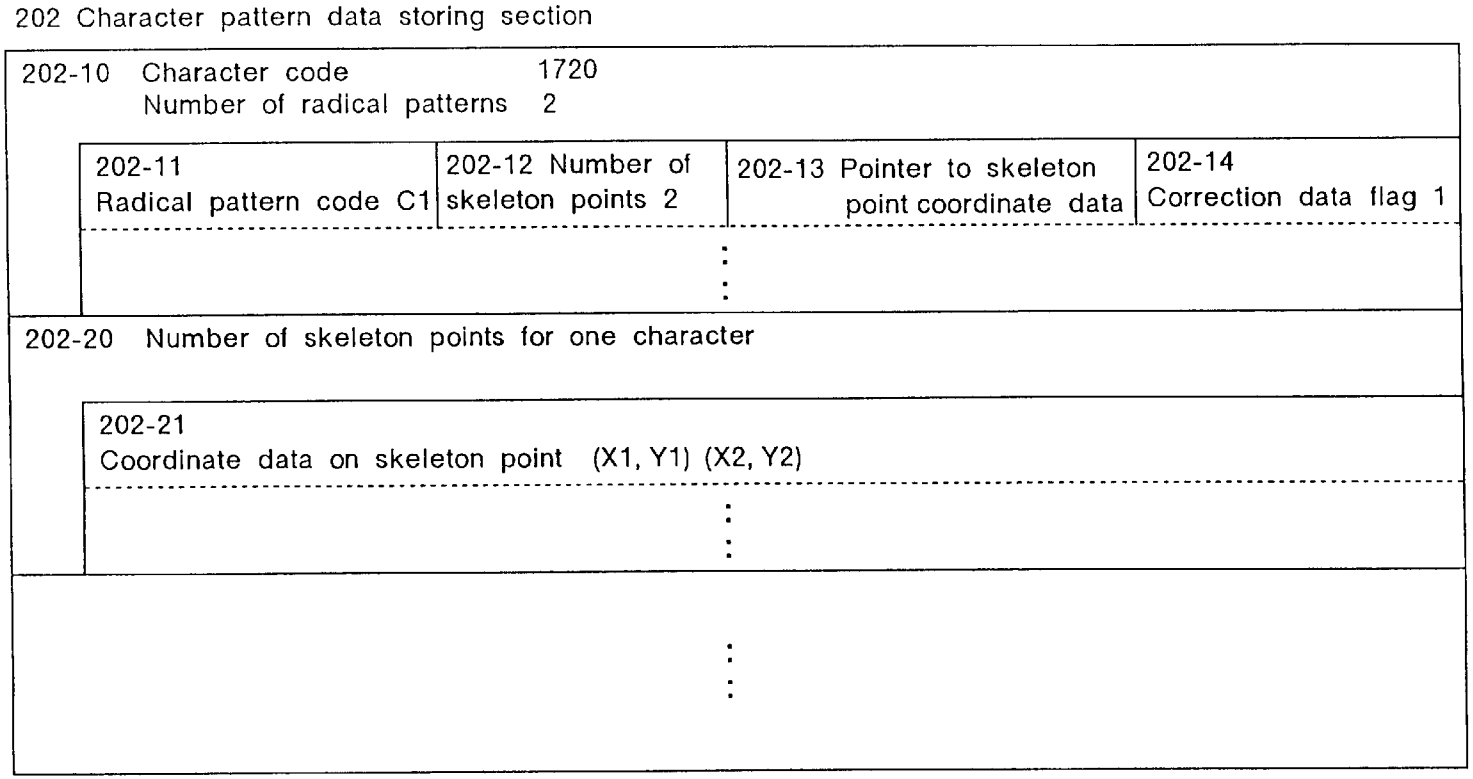
FIG. 12 is a block diagram showing a structure of a character pattern data storing section according to the present invention.

FIG. 12 is a block diagram showing a structure of the character pattern data storing section, in which a character pattern "唄" of a character code "1720" is given as an example. In FIG. 12, the character pattern data storing section 202 stores the character code "1720" and the number of radical patterns "2" forming the character corresponding to the character code (202-10).

As information about the character having the character code, stored are a code number "C1" of a radical pattern "口" forming the character (202-11), a "2" for the number of skeleton points representing arrangement coordinates of the radical pattern (202-12), a pointer to coordinate data of the skeleton points (202-13), and a "1" for a correction data flag if the radical pattern is to be corrected and a "0" if not.

As data on the skeleton points representing arrangement coordinates of the radical pattern, stored are the number of skeleton points "2" (202-20) and coordinate data on the skeleton points "X1, Y1" and "X2, Y2" (202-21). The place in the character pattern where the radical pattern is arranged and the size of the radical pattern are determined by the coordinate values of the skeleton point. The skeleton points here indicate an upper left point "X1, Y1" and a lower right point "X2, Y2" which are opposite vertices of a rectangular enclosing the radical pattern and defining the size of the radical pattern.

The above-described contents of the character pattern data storing section 202 are data on one character pattern. Similarly, the character pattern data on other character patterns are stored in order of the character pattern codes.

Figure 16:
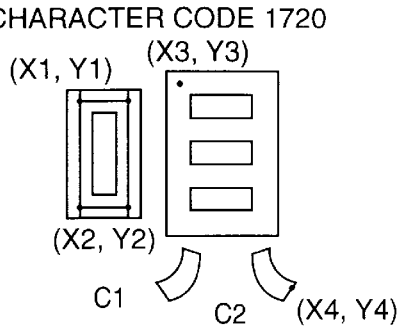
FIGS. 16 (1) to 16 (8) are diagrams showing images of character patterns, in which FIG. 16 (1) shows an image of character pattern data, FIG. 16 (2) shows an image of character pattern data, FIG. 16 (3) shows an image of radical pattern data, FIG. 16 (4) shows an image of basic skeleton pattern data, FIG. 16 (5) shows an image of stroke pattern data, FIG. 16 (6) shows an image of radical pattern data, FIG. 16 (7) shows an image of corrected radical pattern data and FIG. 16 (8) shows an image of corrected character pattern data.
Figure 16:
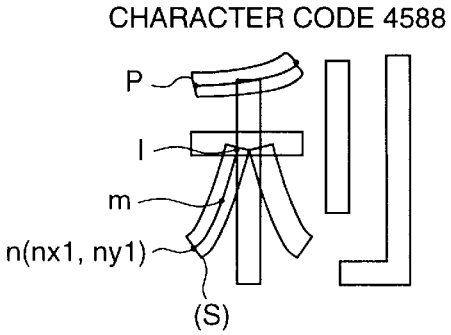
Figure 16:
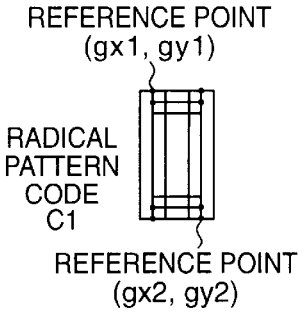
Figure 16:
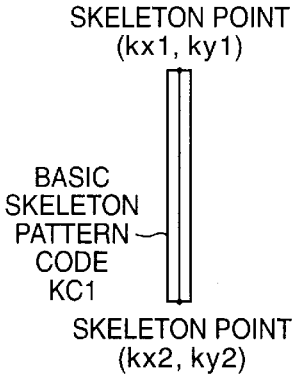
Figure 16:
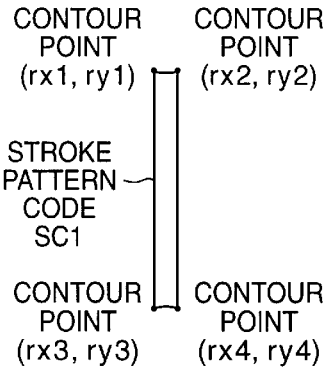
Figure 16:
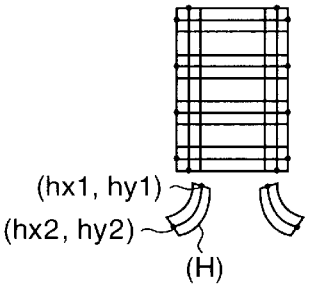
Figure 16:
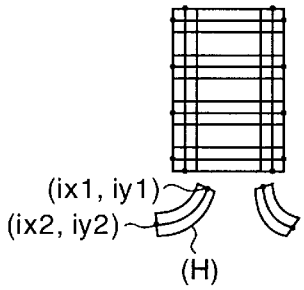
Figure 16:
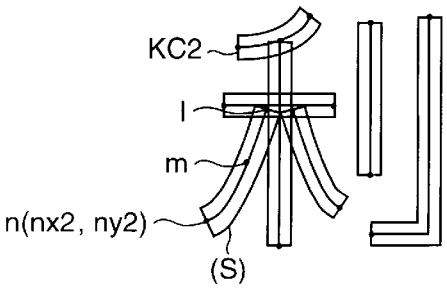

FIGS. 16 (1) to 16 (8) are diagrams showing images of character patterns. FIG. 16 (1) shows an image of character data of "唄" stored in the character pattern data storing section 202. A character code "1720" representing "唄", a radical pattern code "C1" of a radical pattern "口", restoration information representing the position and the size necessary for restoring the shape of the radical pattern "口", a radical pattern code "C2" of a radical pattern "貝", and restoration information of the radical pattern "貝" are stored. The restoration information here indicates coordinates "X3, Y3" and "X4, Y4" for both opposite vertices of a rectangular enclosing the radical pattern.

FIGS. 13*a* to 13*c* are block diagrams showing a structure of the radical pattern data storing section, basic skeleton shape information and basic skeleton synthesis information according to the present invention. As the radical restoration information, stored are the total number of radical pattern data (203-10), basic skeleton shape information (203-20) of a basic skeleton pattern forming a radical pattern, and basic skeleton synthesis information (203-30) for synthesizing basic skeleton patterns to generate a radical pattern.

The basic skeleton shape information (203-20) stores a basic skeleton pattern code "KC1" (203-21), a code number "SC1" (203-22) of a stroke pattern which is contour information for the basic skeleton pattern "KC1", a "2" representing the number (203-23) of skeleton points forming the basic skeleton pattern, and a pointer (203-24) to coordinate data of the skeleton points.

The basic skeleton shape information (203-20) also stores a "2" for the number (203-25) of coordinate data of the skeleton points read by the pointer (203-24), and "kx1, ky1" and "kx2, ky2" (203-26) for the coordinate data number of the skeleton points.

The above-mentioned basic skeleton shape information is data for one basic skeleton pattern. Similarly, the basic skeleton shape information on other basic skeleton patterns are stored in order of the basic skeleton pattern codes Arrangement of the skeleton points of the basic skeleton pattern is determined by the coordinate data (203-26) on the skeleton points and a skeleton of the basic skeleton pattern is formed by a straight line connecting the skeleton points. This skeleton and the stroke pattern which is the contour information generate a basic skeleton pattern.

Referring to FIG. 16 (4), the skeleton points "kx1, ky1" and "kx2, ky2" are connected by a straight line to form a skeleton of the first basic skeleton pattern "KC1" of the radical pattern "口". The basic skeleton pattern is generated by a stroke pattern of the contour information "SC1" corresponding to the basic stroke pattern "KC1" and the skeleton of the basic stroke pattern "KC1". The stroke pattern "SC1" is stored in the stroke pattern data storing section 204.

The basic skeleton synthesis information (203-30) stores the radical pattern code "C1" of "口" and, as information on the radical pattern code "C1" (203-31), the number of basic skeleton patterns "4" included in "C1," the code number "KC1" (203-32) of the basic skeleton pattern forming the radical pattern "C1", the number of reference points "2" (203-33) which are arrangement coordinates of the basic skeleton pattern, and a pointer (203-34) to coordinate data of the reference points.

The basic skeleton synthesis information (203-30) also stores the number of coordinates "2" (203-35) of the reference points read by the pointer (203-34), and the coordinates "gx1, gy1" and "gx2, gy2" (203-36) of the reference points.

The reference points here indicate an upper left point "gx1, gy1" and a lower right points "gx2, gy2" which are opposite vertices of a rectangular enclosing the basic skeleton pattern and representing the size thereof. The arrangement of the basic skeleton pattern is determined by the coordinate data (203-36) of the reference points.

It is assumed that the order of radical patterns forming one character is determined in accordance with the writing order of the character. Further, the order of basic skeleton patterns in one radical pattern is also determined in accordance with the writing order of the character.

The above-described basic skeleton synthesis information is data for one basic skeleton pattern in one radical pattern. Similarly, data for other basic skeleton patterns are also stored in the writing order the basic skeleton patterns.

Figure 14:
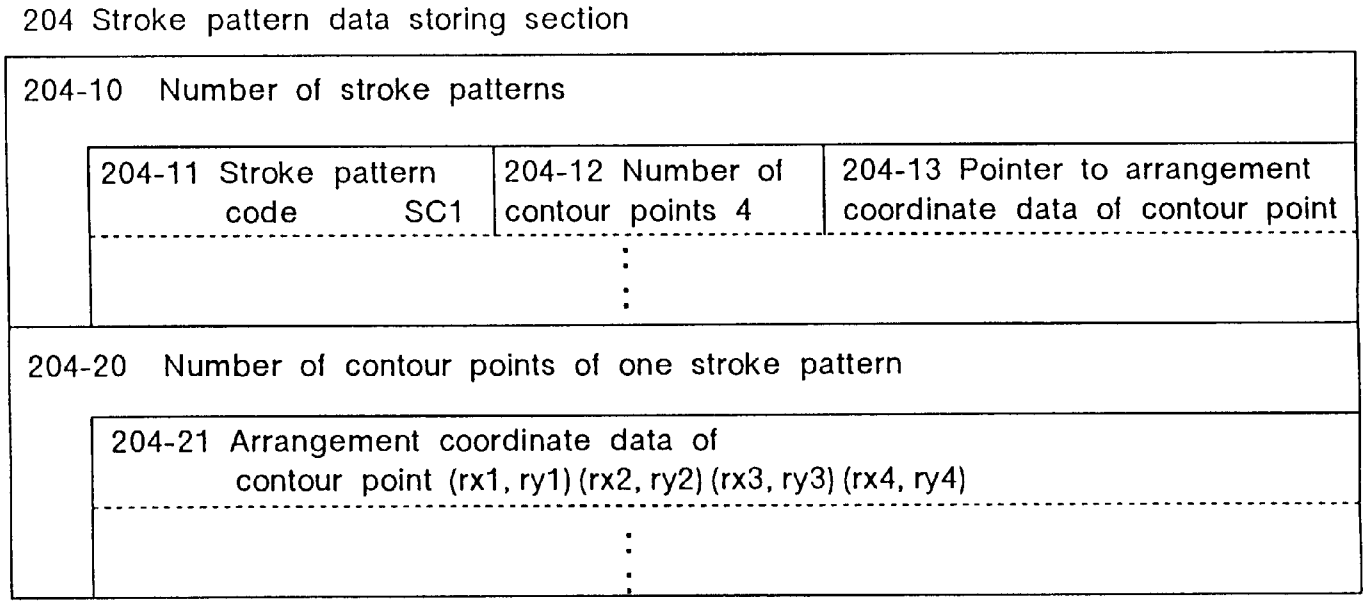
FIG. 14 is a block diagram showing a structure of a stroke pattern data storing section according to the present invention.

FIG. 14 is a block diagram showing a structure of the stroke pattern data storing section according to the present invention. In FIG. 14, the total number (204-10) of stroke patterns is stored, and, as information on a stroke pattern, the code number "SC1" (204-11) of the stroke pattern, the number of contour points "4" (204-12) forming the stroke pattern, and a pointer (204-13) to coordinate data of the contour points are stored.

The stroke pattern data storing section 204 also stores the number of coordinate data "4" (204-10) of the contour points read by the pointer (204-13) to the coordinate data of the contour points, and coordinates of the contour points "rx1, ry1", "rx2, ry2", "rx3, ry3" and "rx4, ry4" (204-21).

Arrangement of the contour points forming the stroke pattern is determined by the coordinate data (204-21) of the contour points, and the stroke pattern is generated from a curve and a straight line connecting the contour points. This stroke pattern and the skeleton form a basic skeleton pattern.

In FIG. 16 (5), a stroke pattern of the first stroke pattern code "SC1" of the radical pattern "口" is generated by connecting the contour points "rx1, ry1", "rx2, ry2", "rx3, ry3" and "rx4, ry4". The basic skeleton pattern is generated by the basic skeleton code "KC1" corresponding to the stroke pattern code "SC1". The basic skeleton pattern code "KC1" and the stroke pattern code "SC1" are stored in the basic skeleton shape information (203-20).

The above-described stroke pattern data corresponds to one stroke pattern. Similarly, data on other stroke patterns are also stored in order of the stroke pattern codes.

Figure 15A:
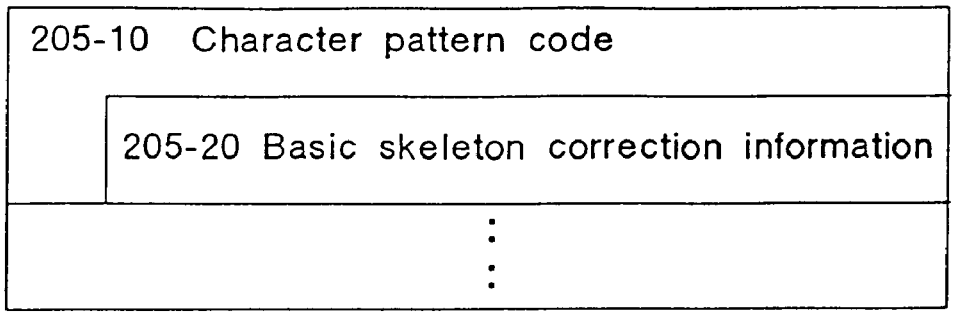

FIGS. 15*a* and 15*b* are block diagrams showing structures of the correction data storing section and basic skeleton correction information according to the present invention, respectively. In FIG. 15*a, there are stored a character pattern code (205-10) and basic skeleton correction information (205-20) for correcting the basic skeleton pattern forming a character pattern having the character pattern code.*

A character pattern "唄" is given as an example. The character pattern "唄" is formed of a radical pattern "口" and a radical pattern "貝". The seventh basic skeleton pattern of the radical pattern "貝" is corrected by counterclockwise rotation by θ° around a lower left point of a rectangle enclosing the basic skeleton and by movement in a lower left direction.

Correction data is stored in order of the radical patterns stored in the character pattern data storing section 202. Therefore, the correction data of the radical patterns forming the character pattern "唄" are stored in order of the radical pattern "口" first and then the radical pattern "貝".

The character pattern code (205-10) includes a character code "1720" of "唄". The basic skeleton correction information (205-20) has a radical pattern correction flag (205-21) representing the presence of the correction data of the radical pattern. If the correction flag is "0", it is judged that correction is not to be performed. If the correction flag is "1", it is judged that the correction is to be performed.

The basic skeleton correction information (205-20) for the first radical pattern "口" forming the character pattern "唄" has "0" for the radical pattern correction flag.

The basic skeleton correction information (205-20) for the second radical pattern "貝" forming the character pattern "唄" stores "1" (205-21) for the radical pattern correction flag. As the contents of the correction, stored are a "7" (205-22) as a correction basic skeleton pattern number, and a rotating angle "θ" (205-23) as rotating angle information. As data for moving reference points of coordinates "hx1, hy1" and "hx2, hy2" of the seventh basic skeleton pattern of the radical pattern "貝" to coordinates "ix1, iy1" and "ix2, iy2" as shown in FIGS. 16(6) and 16(7), "hx1–ix1" (205-24) is stored as coordinate difference data in reference point movement information for hx1, "hy1–iy1" (205-25) is stored as coordinate difference data in reference point movement information for hy1, "hx2–ix2" (205-26) is stored as coordinate difference data in reference point movement information for hx2, and "hy2–iy2" (205-27) is stored as coordinate difference data in reference point movement information for hy2.

If the basic skeleton pattern is corrected by exchanging it with another basic skeleton pattern, a basic skeleton pattern number after exchange is stored in exchange information decision data (205-28). If the basic skeleton pattern is not exchanged, a "0" is stored in the exchange information decision data. Here, the basic skeleton is not exchanged. Therefore, a "0 is stored in the exchange information decision data.

For skeleton transformation information, stored are the number of the basic skeleton points (205-29) of a basic skeleton pattern, the number of a skeleton point to be corrected (205-30), a difference of an x coordinate of the skeleton point as coordinate difference data in movement information for a coordinate nx1 (205-31), and a difference of a y coordinate of the skeleton points as coordinate difference data in skeleton point movement information for a coordinate ny1 (205-32).

Here, correction is not performed by moving the skeleton points to transform the skeleton. For this reason, correction is not carried out with respect to the number of the basic skeleton points (205-29) included in one basic skeleton pattern, the number of a skeleton point to be corrected (205-30), the coordinate difference data (205-31) in the skeleton point movement information for nx1 representing the difference between x coordinates of the skeleton point before and after the correction, and the coordinate difference data (205-32) in the skeleton point movement information for ny1 representing the difference between y coordinates of the skeleton point before and after the correction. All these data are information for transforming a basic skeleton. Therefore, a "0" meaning that a processing is not performed is stored.

A character pattern "利" is given as another example for explaining the structure of correction data. The character pattern "利" is formed of a radical pattern "禾" and a radical pattern "刂". The radical pattern "禾" is subjected to correction by exchanging the basic skeleton pattern of its first stroke with another basic skeleton and by moving skeleton points of its fourth stroke.

Since the correction data is stored in order of the radical patterns stored in the character pattern data storing section 202, the correction data on the radical patterns forming the character pattern "利" are stored in order of the radical pattern "禾" first and then the radical pattern "刂".

The character pattern code (205-10) stores a character code "4588" of "利". The basic skeleton correction information (205-20) for the first radical pattern "禾" forming the character pattern "利" stores a "1" as the radical pattern correction flag (205-21).

Since the first basic skeleton pattern of the radical pattern "禾" is corrected to be exchanged for another basic skeleton pattern, a "1" is stored as the correction basic skeleton pattern number (205-22) and a "KC2" is stored as the basic skeleton pattern number (205-28) after the exchange as the exchange information decision data. Since other correction is not performed, a "0" representing "not to be performed" is stored for the other correction information.

Skeleton points 1, m and n are stored in this order for the fourth basic skeleton pattern (S) shown in FIG. 16(8) of the radical pattern "禾". In order to move the third skeleton point n, "4" (205-22) is stored in the correction basic skeleton pattern number, the number of the basic skeleton points "3" (205-29) is stored in the number of basic skeleton points, and a "3" (205-30) is stored in a correction skeleton point number.

Coordinate difference data for nx1 in the skeleton point movement information (205-31) stores difference data "nx1–nx2" between an x coordinate "nx1" before correction and an x coordinate "nx2" after the correction, and coordinate difference data for ny1 in the skeleton point movement information (205-32) stores difference data "ny1–ny2" between a y coordinate "ny1" before correction and a y coordinate "ny2" after the correction. Since other correction is not performed, a "0" representing "not to be performed" is stored for the other correction information.

The basic skeleton correction information (205-20) for a second radical pattern "刂" forming the character pattern "利" stores "0" as the radical pattern correction flag (205-21).

Figure 17:
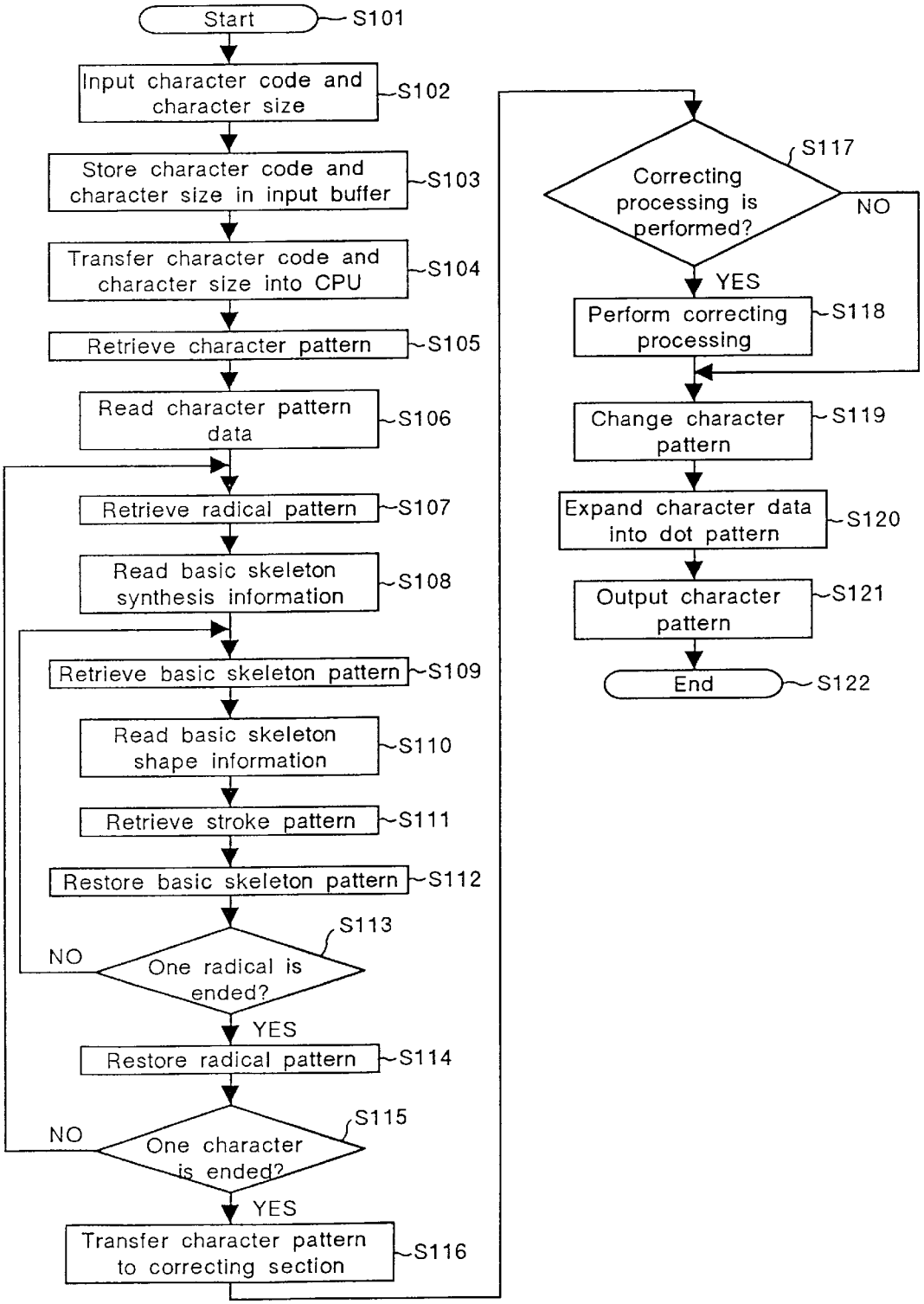
FIG. 17 is a flowchart showing a processing procedure of the character generator according to Embodiment 2 of the present invention.

FIG. 17 is a flowchart showing a processing procedure of the character generator according to the second embodiment of the present invention. Description will be given below with reference to the flowchart and FIG. 9.

Step S101: A character generating processing is started.

Step S102: A character code "1720" of a character pattern "唄", a character size "56 dots" thereof and the like which are information for outputting the character pattern "唄" from the input section 201 to the output section 212 are input by means of an input device such as a keyboard.

Step S103: The input information such as the input character code "1720", the character-size "56 dots" and the like are stored in an input buffer.

Step S104: The character code and the character size stored in the input buffer are transferred to a work memory provided in the data processing section 210. It is assumed that all control operations up to the restoring of the character pattern are performed by the work memory provided in the data processing section 210.

Step S105: Character pattern data having a character code corresponding to the character code "1720" given from the input buffer to the work memory is retrieved from the character pattern data storing section 202 by the character pattern retrieving section 206 provided in the data processing section 210.

If the character code "1720" read into the work memory is retrieved by the character pattern retrieving section 206, character pattern data for one character having the character code "1720" is stored in the input buffer.

Step S106: The data processing section 210 reads, into the work memory, the character code "1720," the number of radical patterns "2" (202-10) forming a character pattern "唄" corresponding to the character code "1720", the radical pattern code "C1" (202-11) of a radical pattern "口" forming the character pattern "唄", the number of skeleton points "2" (202-12) representing arrangement coordinates of the radical pattern "口", and the coordinates "X1, Y1" and "X2, Y2" (202-21) of the skeleton points, and similarly for a radical pattern "貝" forming the character pattern "唄," a radical pattern code, the number of skeleton points, and skeleton point coordinates in the same manner as the radical pattern "口," which information is all stored in the input buffer.

Step S107: Radical pattern data having a radical pattern code corresponding to the radical pattern code "C1" read from the input buffer into the work memory are retrieved from the basic skeleton synthesis information (203-30) of the radical pattern data storing section 203 by the radical pattern retrieving section (207-10).

If the radical pattern retrieving section (207-10) retrieves, from the basic skeleton synthesis information, a radical pattern code identical to the radical pattern code "C1" read into the work memory, the basic skeleton synthesis information for one radical pattern having the radical pattern code "C1" is stored in the input buffer.

Step S108: The data processing section 210 reads, into the work memory, the radical pattern code "C1" of the radical pattern "口," the number of basic skeleton patterns "4" (203-31) forming the radical pattern "口", a code number "KC1" (203-32) of the basic skeleton pattern forming the radical pattern "口", the number of reference points "2" (203-33) which are arrangement coordinates for the basic skeleton pattern "KC1", and the coordinates gx1, gy1" and "gx2, gy2" (203-36) of the reference points, and, also for other basic skeleton patterns forming the radical pattern including a code number, the number of reference points, reference point coordinates for the basic skeleton patterns forming the radical pattern "口" in the same manner as the basic skeleton pattern "KC1," which are stored in the input buffer. Thus the basic skeleton synthesis information for one radical pattern is read into the work memory.

Step S109: The basic skeleton pattern code corresponding to the basic skeleton pattern code "KC1" read into the work memory is retrieved from the basic skeleton shape information (203-20) in the radical pattern data storing section 203 by the basic skeleton pattern retrieving section (207-21).

If the basic skeleton pattern retrieving section (207-21) retrieves, from the basic skeleton shape information, a basic skeleton pattern code identical to the basic skeleton pattern code "KC1" read into the work memory, the basic skeleton shape information for one basic skeleton pattern having the basic skeleton pattern code "KC1" is stored in the input buffer.

Step S110: The data processing section 210 reads, into the work memory, basic skeleton shape information for one basic skeleton pattern storing the basic skeleton pattern code "KC1" (203-21), the code number "SC1" (203-22) of a stroke pattern forming the basic skeleton pattern "KC1", the number of skeleton points "2" (203-23) forming the basic skeleton pattern, and coordinates "kx1, ky1" and "kx2, ky2" (203-26) of the skeleton points which are stored to the input buffer.

Step S111: A stroke pattern code corresponding to the stroke pattern code "SC1" read into the work memory is retrieved from the stroke pattern data storing section 204 by the stroke pattern retrieving section (207-22).

If the stroke pattern retrieving section (207-22) retrieves, from the stroke pattern data storing section 204, a stroke pattern code identical to the stroke pattern code "SC1" read into the work memory, the stroke pattern data for one stroke pattern having the stroke pattern code "SC1" is stored in the input buffer.

Step S112: The basic skeleton pattern restoring section (207-23) in the data processing section 210 reads, into the work memory, stroke pattern data having the stroke pattern code "SC1", the number of contour points "4" (204-12) forming the stroke pattern, and coordinates of the contour points "rx1, ry1", "rx2, ry2", "rx3, ry3" and "rx4, ry4" (204-21), which are stored in the input buffer.

The stroke pattern is restored according to the coordinate data of the contour points "rx1, ry1", "rx2, ry2", "rx3, ry3" and "rx4, ry4" read into the work memory.

Then, the basic skeleton pattern restoring section (207-23) restores a skeleton of the basic skeleton pattern based on the coordinate data of the skeleton points "kx1, ky1" and "kx2, ky2" (203-26) of the basic skeleton shape information read into the work memory. The basic skeleton pattern is formed of the restored skeleton and the restored stroke pattern.

Thus, the first basic skeleton "KC1" of one radical in one character has been restored.

Step S113: Here, since the number of the restored basic skeleton pattern is smaller than the number of basic skeleton patterns "4" of the basic skeleton synthesis information read into the work memory, the routine returns to step S109 to restore basic skeleton patterns which have not been restored yet.

The basic skeleton patterns are restored in order of the pattern codes stored in the basic skeleton synthesis information read into the work memory. For this reason, of the basic skeleton patterns which have not been restored, the one which corresponds to the basic skeleton pattern code stored next to the restored basic skeleton pattern "KC1" are restored next.

When the number of restored basic skeleton patterns becomes equal to the number of the basic skeleton patterns "4" of the basic skeleton synthesis information, it is judged that all the basic skeleton patterns forming the radical pattern "口" have been restored.

Step S114: The radical pattern changing section (207-30) changes the radical pattern "口" having all basic skeleton patterns restored according to the coordinates "X1, Y1" and "X2, Y2" (202-21) of the skeleton points of the radical pattern in the character pattern data read into the work memory.

Thus, the radical pattern "口" forming the character pattern "唄" has been restored.

Step S115: If the number of restored radical patterns is smaller than the number of the radical patterns "2" of the character pattern data read into the work memory, the routine returns to Step S107 to restore the radical patterns which have not been restored yet.

The radical patterns are restored in order of the radical pattern codes stored in the character pattern data read into the work memory. For this reason, of the radical patterns which have not been restored, the one which corresponds to the radical pattern code stored next to the restored radical pattern "C1" is then restored.

When the number of restored radical patterns becomes equal to the number of the radical patterns "2" of the character pattern data, it is judged that all the radical patterns forming the character pattern "口" have been restored.

Step S116: The character pattern data whose radical patterns have been restored are transferred to the correcting section 208.

Step S117: In the correcting section 208, if a "1" is stored as the correction data flag (202-14) in the character pattern data of "唄" whose radical patterns "口" and "貝" have been restored, the routine proceeds to Step S118 where the character pattern code "1720" stored in the same character pattern data on "唄" is retrieved from the correction data storing section 205. If the correction data storing section 205 has the same character code "1720", correction data for the character having the character code "1720" is stored in the input buffer.

If a "0" is stored as the correction data flag in the character pattern data, it is judged that correction is not to be executed, and therefore, the routine proceeds to Step S119.

The character pattern "唄" is formed of the radical pattern "口," and the radical pattern "貝."Referring to FIG. 16(6) and 16(7), a basic skeleton pattern (H) which is the seventh stroke of the radical pattern "貝" is subjected to correction by counterclockwise rotation of θ° around a lower left point of a rectangle enclosing the basic skeleton and by movement in a lower left direction.

The basic skeleton correction information (205-20) for correcting the basic skeleton patterns are stored in order of the radical pattern codes stored in the character pattern data, and accordingly, in order of the radical pattern "口" and then the radical pattern "貝". The correction processing is performed by specifying radical patterns to be corrected in order of the radical pattern codes.

Figure 18:
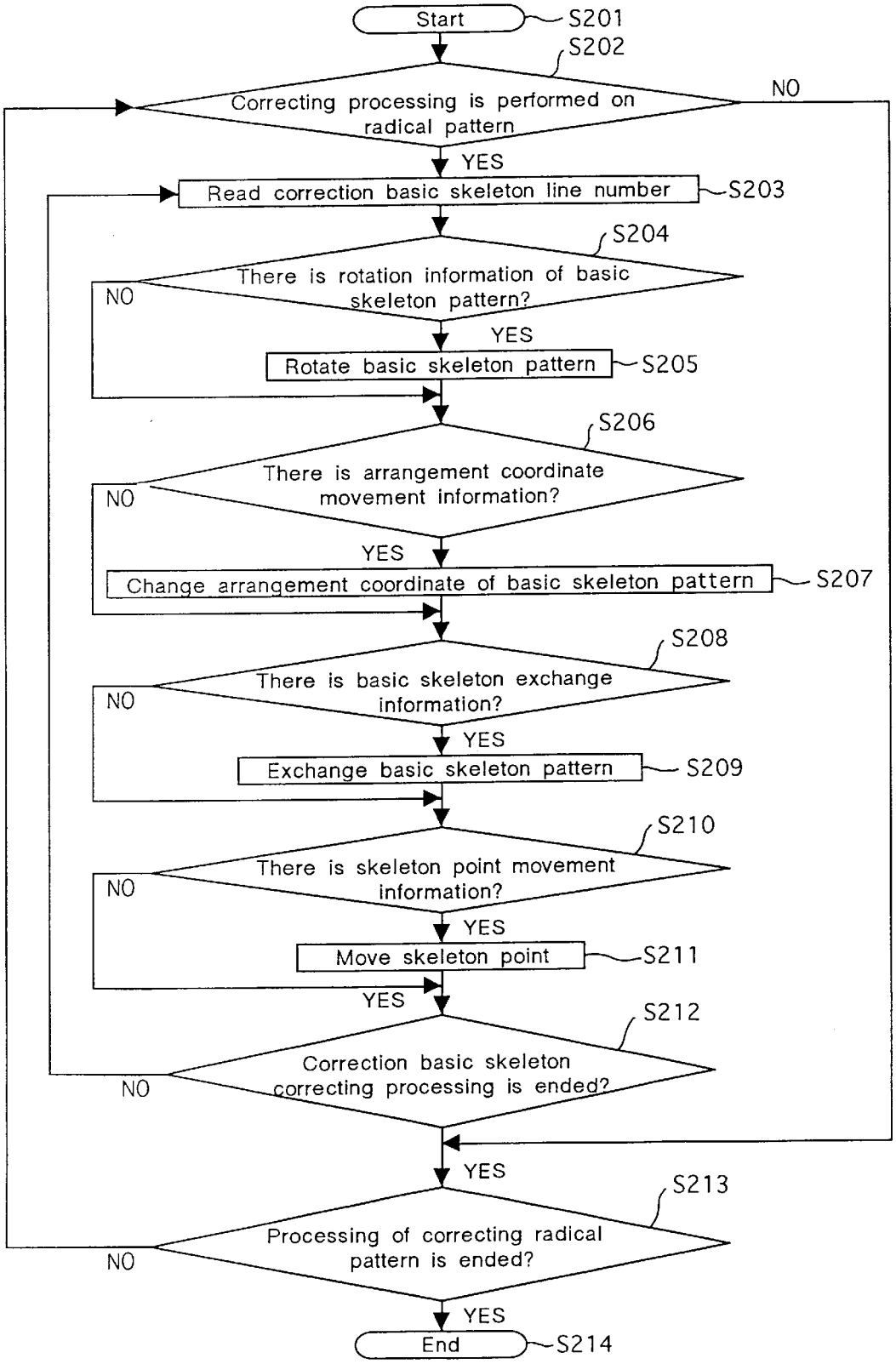
FIG. 18 is a flowchart showing a processing procedure of the correcting section provided in a data processing section according to the present invention.

FIG. 18 is a flowchart showing a procedure for a processing of the correcting section provided in the data processing section according to the present invention. In FIG. 18, the following processing is performed.

Step S202: Since a "0" is stored as the radical pattern correction flag (205-21) of the radical pattern "口" included in the basic skeleton correction information (205-20) of the correction data stored in the input buffer, it is judged that the radical pattern "口" is not corrected and the radical pattern correction flag of the next radical pattern "貝" is read.

Since "1" is stored in the radical pattern correction flag of the radical pattern "貝", the basic skeleton correction information (205-20) having the radical pattern correction flag is read into the work memory.

Step S203: Since "7" (205-22) is stored in the correction basic skeleton line number read into the work memory, the seventh basic skeleton pattern (H) of the radical pattern "貝" is corrected.

Step S204: Since the rotating angle "θ°" is stored in the rotating angle information, it is considered that rotation is performed.

Step S205: Correction is performed by rotating each reference point of the seventh basic skeleton pattern (H) of "貝" by the rotating angle "θ°" about a lower left point of a rectangle enclosing the basic skeleton pattern as a center of rotation. The coordinates of each reference point after the rotation is calculated for correction movement of the reference points.

Step S206: For reference point coordinates "hx1, hy1" and "hx2, hy2" of the basic skeleton pattern (H) of the line number "7", "hx1–ix1" (205-24) is stored in the coordinate difference data of the reference point movement information hx1, "hy1–iy1" (205-25) is stored in the coordinate difference data of the reference point movement information hy1, "hx2–ix2" (205-26) is stored in the coordinate difference data of the reference point movement information hx2, and "hy2–iy2" (205-27) is stored in the coordinate difference data of the reference point movement information hy2. Therefore, it is judged that two reference points are moved and a size is changed.

Step S207: A coordinate value is calculated by adding difference data to a coordinate value of each reference point to be moved.

Except for the foregoing, a "0" is stored as the basic skeleton correction information of the seventh basic skeleton pattern (H) of the radical pattern "貝". Therefore, correction of the seventh basic skeleton pattern (H) of the radical pattern "貝" is ended.

Step S212: When correction of one basic skeleton is ended, a next basic skeleton line number is retrieved.

In this example, only the seventh basic skeleton pattern (H) is corrected, and there are no other basic skeleton line numbers than "7". Therefore, it is judged that the processing of correcting the radical pattern "貝" is ended. Then, the routine proceeds to Step S213.

Step S213: Since no other radical patterns are included further to "貝", there is not basic skeleton correction data.

Step S214: Consequently, it is judged that the processing of correcting the character pattern "唄" is ended. The character pattern "唄" is transferred to the character pattern changing section 209.

Step S119: The character pattern changing section 209 changes the character pattern "唄" having the radical pattern "口" and the radical pattern "貝" restored, according to a character size "56 dots" read into the work memory, and transfers the changed character pattern to the expanding section 211.

Step S120: The expanding section 211 expands the character pattern data "唄" transferred from the work memory into a dot pattern, and transfers the dot pattern to the output section 212.

Step S121: The output section 212 allows the output device to output the character pattern expanded into the dot pattern transferred from the expanding section 211.

Step S122: The processing is ended.

Next, a character pattern "利" will be given as another example of the processing procedure of the correcting section 208. The character pattern "利" is formed of a radical pattern "禾" and a radical pattern "刂", and is corrected by exchanging the first basic skeleton pattern of the radical pattern "禾" for another basic skeleton pattern and moving the third skeleton point of the fourth basic skeleton pattern.

At Step S117 shown in FIG. 17, since a "1" is stored as the correction data flag (202-14) in character pattern data of "利" having the radical pattern "禾" and the radical pattern "刂" restored, the correcting section 208 retrieves, from the correction data storing section 205, a character pattern code identical to a character pattern code "4588" stored in the character pattern data. If the correction data storing section 205 has the character pattern code "4588", correction data for one character having the character pattern code "4588" is stored in the input buffer and the routine proceeds to Step S118.

The basic skeleton correction information for correcting the basic skeleton patterns is stored in order of the radical pattern "禾" and then the radical pattern "刂" according to the order of the radical pattern codes stored in the character pattern data. The correcting processing is performed by specifying a radical pattern to be corrected according to the order of the radical pattern codes.

At Step S202 shown in FIG. 18, since a "1" is stored in the radical pattern correction flag of the radical pattern "禾" which is stored in the basic skeleton correction information of the correction data stored in the input buffer, the basic skeleton correction information storing the radical pattern change flag "1" is read into the work memory.

Step S203: Since a "1" is stored in the correction basic skeleton line number read into the work memory, the first basic skeleton pattern (P) of the radical pattern "禾" is corrected.

Step S204: Since a "0" is stored in the rotating angle information, it is judged that rotating correction is not to be performed and the routine proceeds to Step S206.

Step S206: Since a "0" is stored in coordinate difference data of reference point movement information for px1, py1, px2 and py2, it is judged that the processing of moving the reference points is not performed and the routine proceeds to Step S208.

Step S208: Since a basic skeleton pattern code "KC2" obtained after exchange is stored in the exchange information decision data, it is judged that the basic skeleton is to be exchanged.

Step S209: The basic skeleton pattern (P) is exchanged for the basic skeleton pattern "KC2".

Since a "0" is stored in the basic skeleton correction information following the exchange information for the first basic skeleton pattern (P) of the radical pattern "禾", the processing of correcting the first basic skeleton pattern (P) of the radical pattern "禾" is ended.

Step S212: When one basic skeleton is completely corrected, a next basic skeleton line number is retrieved. Among basic skeleton patterns forming the radical pattern "禾", the first basic skeleton pattern (P) and the fourth basic skeleton pattern (S) are corrected, and a "4" is also stored as the basic skeleton line number. At Step S212, since there is correction information for the fourth basic skeleton, the routine returns to Step S203 to read the correction basic skeleton line number.

Step S204: Since a "0" is stored in the rotating angle information, it is judged that the rotating correction is not performed. Then, the routine proceeds to Step S206.

Step S206: Since a "0" is stored in coordinate difference data of the reference point movement information for sx1, sy1, sx2, and sy2, it is judged that the processing of moving the reference points is not to be performed. Then, the routine proceeds to Step S208.

Step S208: Since a "0" is stored in the exchange information decision data, it is judged that the basic skeleton pattern is not to be exchanged. Then, the routine proceeds to Step S210.

Step S210: Skeleton points 1, m and n are stored in this order about the basic skeleton pattern (S) to be transformed. Here, the third skeleton point n is to be moved for transformation. Since the total number of the skeleton points "3" is stored in the number of basic skeleton points, it is judged that a basic skeleton point is to be moved. Then, the routine proceeds to Step S211.

Step S211: Since a "3" which is the number of the basic skeleton point n is stored in the basic skeleton point number (205-29), difference "nx1–nx2" between an x coordinate "nx1" before correction and an x coordinate "nx2" after the correction is stored in the skeleton point movement information for nx1 as coordinate difference data (205-31), difference "ny1–ny2" between a y coordinate "ny1" before the correction and a y coordinate "ny2" after the correction is stored in the skeleton point movement information for ny1 as coordinate difference data (205-32), the basic skeleton point n is moved to a point of a coordinate value "nx2, ny2" calculated by adding the difference to the coordinate value of the basic skeleton point n.

The processing of correcting the fourth basic skeleton pattern (S) of the radical pattern "禾" is ended.

Step S212: When the basic skeleton pattern (S) is completely corrected, a next basic skeleton line number is retrieved.

Only the first and fourth basic skeleton patterns (P) and (S) which form the radical pattern "禾" are to be corrected, and only "1" and "4" are stored as the basic skeleton numbers to be corrected. Therefore, it is judged that the processing of correcting the radical pattern "禾" is ended.

Step S213: The processing of correcting the radical pattern "禾" forming the character pattern "利" is ended, and the basic skeleton correction data of the radical pattern "刂" is then retrieved. Since a "0" is stored as the radical pattern correction flag of the "刂", it is judged that correction is not to be performed. Thus, the processing of correcting the "刂" is ended.

Since there is no other radical pattern which forms the character pattern "利", it is judged that the processing of correcting the character pattern "利" is ended, and the character pattern "利" is transferred to the character pattern changing section.

According to Embodiment 1 of the present invention, when generating character data having a plurality of typefaces from character information for one typeface sharing radical information of kanji, radical information is prepared for each typeface and character data is converted according to a typeface to be generated. Furthermore, the radical information are also expanded and synthesized according to the typefaces. Consequently, it is possible to generate character data of high quality which have a shape suitable for a desired typeface.

When generating radical information having a plurality of typefaces from radical information for one typeface, information for converting radical information for each typeface is prepared and the radical information is generated based on the conversion information according to a typeface to be generated. Therefore, radical information can be generated in a plurality of typefaces with a reduced amount of radical information and conversion information for one typeface.

Furthermore, the present invention can be applied to character generation from skeleton information and sticking information (contour information). Consequently, character data having a plurality of typefaces can be generated more easily.

According to Embodiment 2 of the present invention, a plurality of basic skeleton patterns included in a radical pattern can individually be specified and restored to a radical pattern suitable for each character pattern. Also in a character generating method wherein components such as a line of one stroke, a point thereof and the like and components forming a common portion such as a radical are hierarchically stored as parts which are combined according to a character shape, the amount of data can be reduced and the same shape of a radical pattern can be restored faithfully so that a character pattern of high quality can be generated.

In addition, provided is the correcting section which serves to transform the contour and skeleton of a radical pattern which is a component of a character pattern based on correction information including contour transformation information and skeleton transformation information. Accordingly, the contour and skeleton of basic skeleton patterns forming the radical pattern are transformed. Therefore, a precise correcting processing can be performed for the basic skeleton patterns forming the radical pattern.

Furthermore, the correcting section includes the basic skeleton rotating section, basic skeleton arrangement coordinate moving section, basic skeleton exchanging section and skeleton point moving section. Therefore, the basic skeleton pattern is rotated, moved and exchanged by the basic skeleton rotating section, the basic skeleton arrangement coordinate moving section and the basic skeleton exchanging section, and a skeleton point of the basic skeleton pattern is moved by the skeleton point moving section. Thus, the precise correcting processing can be performed for the basic skeleton patterns forming the radical pattern.

According to the present invention, character structure information including radical structure information representing the kind and the position/size of a radical of kanji and stroke information on each stroke other than the radical are stored for each character code and for each typeface, stroke information on each stroke of the radical based on the radical structure information is stored for each typeface, contour information corresponding to the stroke information is stored for each typeface, the stroke information such as radicals are sequentially read according to a typeface and positioned and the contour information are assigned to generate character patterns. Thus, a reduced amount of data can generate, according to each typeface, character patterns of high quality having well-balanced strokes of good shape.

Although the present invention has fully been described by way of example with reference to the accompanying drawings, it is to be understood that various changes and modifications will be apparent to those skilled in the art. Therefore, unless otherwise such changes and modifications depart from the scope of the invention, they should be construed as being included therein.

What is claimed is:

1. A character generator comprising:

an input section for inputting information including a character code, a typeface, and a character size of a character pattern to be generated;

a character information storing section for storing, for each character code, character structure information including radical structure information representing a kind, a position and a size of a radical of kanji of a character and stroke information of each stroke of the character other than the radical;

a radical information storing section for storing, for each typeface, stroke information on each stroke of the radical based on the radical structure information;

a contour information storing section for storing, for each typeface, contour information corresponding to the stroke information;

a stroke information reading section for reading, from the character information storing section, the radical structure information and the stroke information of each stroke of the character other than the radical included in one character structure information based on the character code and the typeface input by the input section, and reading the stroke information on the radical corresponding to the read radical structure information from the radical information storing section;

a character generating section for reading the contour information corresponding to the read stroke information from the contour information storing section according to the input typeface and generating one character pattern;

an output section for outputting the generated character pattern;

a correction information storing section for storing correction information for correcting a stroke of the radical of the generated character pattern according to a shape of the character pattern; and a radical correcting section for correcting a stroke of the radical based on the correction information.

2. The character generator as defined in claim 1, wherein the radical structure information stored in the character information storing section includes a part number of a radical representing the kind of the radical and coordinates of two points representing the position and size of the radical.

3. The character generator as defined in claim 1, wherein the stroke information of each stroke of the character other than the radical stored in the character information storing section includes a part number of contour information representing a stroke shape and coordinates of skeleton points representing the position and size of the stroke.

4. The character generator as defined in claim 1, wherein the radical information storing section stores a part number of a radical representing the kind of the radical, a part number of contour information representing a stroke shape of the radical corresponding to the part number, and coordinates of skeleton points based on the radical structure information.

5. The character generator as defined in claim 1, wherein the contour information stored in the contour information storing section includes a part number of the contour information representing a stroke shape and coordinates of a contour point corresponding to the part number.

6. A character generator comprising:

an input section for inputting information including a character code, a typeface, and a character size of a character pattern to be generated;

a character information storing section for storing, for each character code, character structure information including radical structure information representing a kind, a position and a size of a radical of kanji of a character and stroke information of each stroke of the character other than the radical;

a radical information storing section for storing, for each typeface, stroke information on each stroke of the radical based on the radical structure information;

a contour information storing section for storing, for each typeface, contour information corresponding to the stroke information;

a stroke information reading section for reading, from the character information storing section, the radical structure information and the stroke information of each stroke of the character other than the radical included in one character structure information based on the character code and the typeface input by the input section, and reading the stroke information on the radical corresponding to the read radical structure information from the radical information storing section;

a character generating section for reading the contour information corresponding to the read stroke information from the contour information storing section according to the input typeface and generating one character pattern; and an output section for outputting the generated character pattern, the character generator further including a correction information storing section for storing correction information for correcting a stroke of the radical according to a shape of the character pattern, and a radical correction section for correcting a contour, a skeleton, an inclination, and arrangement of the stroke of the radical based on the correction information.

7. The character generator as defined in claim 6, wherein the correction information includes contour transformation information, skeleton transformation information and rotating angle information for the stroke of the radical.

8. A character generator comprising:

an input section for inputting information including a character code, a typeface, and a character size of a character pattern to be generated;

a character information storing section for storing, for each character code, character structure information including radical structure information representing a kind, a position and a size of a radical of kanji of a character and stroke information of each stroke of the character other than the radical;

a radical information storing section for storing, for each typeface, stroke information on each stroke of the radical based on the radical structure information;

a contour information storing section for storing, for each typeface, contour information corresponding to the stroke information;

a stroke information reading section for reading, from the character information storing section, the radical structure information and the stroke information of each stroke of the character other than the radical included in one character structure information based on the character code and the typeface input by the input section, and reading the stroke information on the radical corresponding to the read radical structure information from the radical information storing section;

a character generating section for reading the contour information corresponding to the read stroke information from the contour information storing section according to the input typeface and generating one character pattern; and an output section for outputting the generated character pattern, the character generator further including a correction information storing section for storing correction information for correcting a stroke of the radical according to a shape of the character pattern, and a radical correction section for correcting a contour, a skeleton, an inclination, and arrangement of the stroke of the radical based on the correction information, the correction information storing section further having a function of storing correction information including arrangement coordinate movement information, basic skeleton exchange information and skeleton point movement information for the stroke of the radical, and the radical correcting section further moving the stroke of the radical based on the arrangement coordinate movement information, exchanging the skeleton of the stroke based on the basic skeleton exchange information, and moving a skeleton point of the stroke based on the skeleton point movement information.

9. A character generator comprising:

an input section for inputting information including a character code, a typeface and a character size of a character pattern to be generated;

a storage for storing character structure information including radical structure information representing a kind, position and size of a radical of a character and stroke information of each stroke of the character other than the radical for each character code, stroke information on each stroke of the radical and contour information corresponding to the stroke information for each typeface, and correction information for correcting a stroke of the radical; and a character generating section for transforming each stroke information in accordance with the input information, reading the contour information corresponding to the transformed stroke information from the storage according to the input typeface to generate a character pattern and correcting the generated character pattern based on the correction information.

10. The character generator of claim 9, wherein said character generating section transforms contour, skeleton, inclination and arrangement of a stroke of the radical.

11. The character generator of claim 9, wherein the radical is a radical of a kanji character.

12. The character generator of claim 9, further comprising an output section for outputting the generated character pattern.

13. A method of character generation comprising the steps of:

inputting information including a character code, a typeface and a character size of a character pattern to be generated;

storing character structure information including radical structure information representing a kind, position and size of a radical of a character and stroke information of each stroke of the character other than the radical for each character code, stroke information on each stroke of the radical and contour information corresponding to the stroke information for each typeface, and correction information for correcting a stroke of the radical;

transforming each stroke information in accordance with the input information and reading the stored contour information corresponding to the transformed stroke information according to the input typeface to generate a character pattern; and correcting the generated character pattern based on the correction information.

14. The method of character generation of claim 13, wherein said step of transforming comprises transforming contour, skeleton, inclination and arrangement of a stroke of the radical.

15. The method of character generation of claim 13, wherein the radical is a radical of a kanji character.

16. The method of character generation of claim 13, further comprising outputting the generated character pattern.

* * * * *